US010140795B2

(12) United States Patent
Kim et al.

(10) Patent No.: US 10,140,795 B2
(45) Date of Patent: Nov. 27, 2018

(54) FOOD STORAGE APPARATUS AND METHOD OF CONTROLLING THE SAME

(71) Applicant: Samsung Electronics Co., Ltd., Suwon-si (KR)

(72) Inventors: Do-Hyung Kim, Suwon-si (KR); Yoon Young Kim, Suwon-si (KR); Jung Yeob Kim, Suwon-si (KR); Ik Keun Kim, Suwon-si (KR); Chul Hee Kim, Hwaseong-si (KR); Dong Nyeol Ryu, Suwon-si (KR); Oun Gu Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 64 days.

(21) Appl. No.: 15/259,590

(22) Filed: Sep. 8, 2016

(65) Prior Publication Data

US 2017/0069150 A1 Mar. 9, 2017

(30) Foreign Application Priority Data

Sep. 8, 2015 (KR) ..... 10-2015-0127068

(51) Int. Cl.
*G07C 9/00* (2006.01)

(52) U.S. Cl.
CPC ..... *G07C 9/00309* (2013.01); *G07C 9/00111* (2013.01); *G07C 9/00896* (2013.01); *G07C 2209/62* (2013.01); *G07C 2209/64* (2013.01)

(58) Field of Classification Search
CPC ..... G07C 9/00309; G07C 9/00896; G07C 2209/62; G07C 9/00111; G07C 2209/64;
(Continued)

(56) References Cited

U.S. PATENT DOCUMENTS 7,728,711 B2 * 6/2010 Shoenfeld ..... E05B 47/0012 340/5.1
8,063,735 B2 * 11/2011 Shoenfeld ..... A61B 50/10 340/5.73

(Continued)

FOREIGN PATENT DOCUMENTS

KR 10-2005-0091693 9/2005
KR 10-2006-0077956 7/2006

(Continued)

*Primary Examiner* — Ali Neyzari
(74) *Attorney, Agent, or Firm* — Staas & Halsey LLP

(57) ABSTRACT

Disclosed herein are a food storage apparatus with improved security performance due to performing of a lock/unlock function from far away and a method of controlling the same. Also, provided are a food storage apparatus which allows a user far away to take appropriate measures by reporting approach of an unauthorized person, opening of a door, etc. or to check a thief or stolen food and a method of controlling the same. The food storage apparatus includes a body in which a storage space for storing food is formed, a door installed on the body to be openable, a locking unit which locks the door, a communication unit which communicates with an external terminal to receive a locking command, and a control unit which controls the locking unit to lock the door when the locking command is received from the terminal.

12 Claims, 28 Drawing Sheets

(58) Field of Classification Search
CPC ..... A61B 50/10; E05B 47/0012; E05B 63/24; F25D 29/00; G07F 11/002; G06Q 10/087
USPC ..... 340/5.3, 5.73, 542
See application file for complete search history.

(56) References Cited

U.S. PATENT DOCUMENTS

| | | | | |
|---|---|---|---|---|
| 8,154,404 | B2 * | 4/2012 | Diener | E05B 45/06 340/541 |
| 9,349,238 | B2 * | 5/2016 | Tkachenko | G07F 11/002 |
| 9,934,657 | B2 * | 4/2018 | Tkachenko | G07G 1/009 |
| 2011/0166694 | A1 | 7/2011 | Griffits et al. | |

FOREIGN PATENT DOCUMENTS

| | | |
|---|---|---|
| KR | 10-2009-0043993 | 5/2009 |
| KR | 10-2015-0034930 | 4/2015 |

* cited by examiner

FOOD STORAGE APPARATUS AND METHOD OF CONTROLLING THE SAME

CROSS-REFERENCE TO RELATED APPLICATION

This application claims the benefit of Korean Patent Application No. 10-2015-0127068, filed on Sep. 8, 2015 in the Korean Intellectual Property Office, the disclosure of which is incorporated herein by reference.

BACKGROUND

1. Field

Embodiments of the present disclosure relate to a food storage apparatus capable of storing food and a method of controlling the same.

2. Description of the Related Art

Generally, refrigerators are home appliances which include a storage space which stores food and a cool air supply unit which supplies cool air to the storage space to keep the food fresh.

Recently, as needs for refrigerators capable of storing particular food at an optimal temperature beyond generally keeping food refrigerated have increased, kimchi refrigerators capable of keeping kimchi in an optimal state, wine refrigerators capable of keeping wine in an optimal state while maintaining taste of the wine, etc. have been on the market.

Meanwhile, there is a range of prices for wine from low-priced wine to high-priced wine according to type, and also there are wines with very high scarcity value regardless of price. Accordingly, since wine is treated not as just an alcoholic beverage but as a collectable item, wine refrigerators need not only to simply keep wine but also to prevent wine from being lost or stolen.

SUMMARY

Therefore, it is an aspect of the present disclosure to provide a food storage apparatus with improved security by executing a lock/unlock function at long distance and a method of controlling the same.

It is another aspect of the present disclosure to provide a food storage apparatus which reports an approach of an unauthorized person, opening of a door, etc. and thereby allows a user far away to take appropriate measures or to recognize a thief or stolen food and a method of controlling the same.

Additional aspects of the present disclosure will be set forth in part in the description which follows and, in part, will be obvious from the description, or may be learned by practice of the present disclosure.

In accordance with one aspect of the present disclosure, a food storage apparatus includes a body in which a storage space for storing food is formed, a door installed on the body to be openable, a locking unit which locks the door, a communication unit which communicates with an external terminal to receive a locking command, and a control unit which controls the locking unit to lock the door when the locking command is received from the terminal.

The locking unit may include a bracket installed at the door, a shaft installed at the body to be connectable to or separable from the bracket, and a locking motor which provides power for connecting or separating the shaft to or from the bracket.

A door sensor which senses opening and closing of the door may be further included.

The communication unit may transmit a door opening signal to the terminal when the door sensor senses opening of the door.

An image sensor installed to face toward a front or side of the body to take an ambient image of the door may be further included.

The control unit may control the image sensor to take an image when the door sensor senses opening of the door.

The communication unit may transmit the image captured by the image sensor to the terminal.

At least one of a display unit and a speaker may be further included. Here, when the opening of the door is sensed, the control unit may control at least one of the display unit and the speaker to output a warning which reports that the opening is unauthorized.

A proximity sensor which senses an object which approaches the door may be further included.

The control unit may control the image sensor to capture an image when the proximity sensor senses an object which approaches the door within a preset distance.

The communication unit may transmit an object approach signal to the terminal when the proximity sensor senses an object which approaches the door within a preset distance.

The control unit may control the locking unit to lock the door when the proximity sensor senses an object which approaches the door within a preset distance.

At least one of a display unit and a speaker may be further included. Here, when the proximity sensor senses an object which approaches the door within a preset distance, the control unit may control at least one of the display unit and the speaker to output a warning which reports that the approach is unauthorized.

A rack formed in the body to store food and a wine sensor installed on the rack to sense whether the food is stored may be further included.

The control unit may determine information on stolen food based on output data of the food sensor, and the communication unit may transmit the information on the stolen food to the terminal.

In accordance with another aspect of the present disclosure, a food storage apparatus includes a body in which a storage space for storing food is formed, a door installed on the body to be openable, an image sensor which takes an ambient image of the door, and a communication unit which transmits the captured ambient image of the door to an external terminal.

A door sensor which senses opening and closing of the door may be further included.

The communication unit may transmit a door opening signal to the terminal when the door sensor senses opening of the door.

The control unit may control the image sensor to take an image when the door sensor senses opening of the door.

At least one of a display unit and a speaker may be further included. Here, when the opening of the door is sensed, the control unit may control at least one of the display unit and the speaker to output a warning which reports that the opening is unauthorized.

A proximity sensor which senses an object which approaches the door may be further included.

The control unit may control the image sensor to capture an image when the proximity sensor senses an object which approaches the door within a preset distance.

The communication unit may transmit an object approach signal to the terminal when the proximity sensor senses an object which approaches the door within a preset distance.

At least one of a display unit and a speaker may be further included. Here, when the proximity sensor senses an object which approaches the door within a preset distance, the control unit may control at least one of the display unit and the speaker to output a warning which reports that the approach is unauthorized.

A rack formed in the body to store food and a food sensor installed on the rack to sense whether the food is stored may be further included.

The control unit may determine information on food taken out based on output data of the food sensor, and the communication unit may transmit, to the terminal, the information on the food taken out.

A storage unit which maps the information on food taken out to the ambient image of the door captured when the food is being taken out or to information on a person who takes out the food included in the ambient image of the door and stores may be further included.

In accordance with one aspect of the present disclosure, a method of controlling a food storage apparatus capable of communicating with an external terminal includes sensing whether a door is open, transmitting a door opening signal to a terminal when opening of the door is sensed, capturing an ambient image of the door, and transmitting the captured ambient image of the door to the terminal.

The food storage apparatus may include one of a display unit and a speaker. Here, the method may further include controlling one of the display unit and the speaker to output a warning which reports that the sensed opening is unauthorized.

The method may further include determining information on food taken out based on output data of a food sensor which senses whether the food is stored and transmitting, to the terminal, the information on the food taken out.

The method may further include locking the door when the opening of the door is sensed.

The method may further include mapping the information on food taken out to the ambient image of the door captured when the food is being taken out or information to a person who takes out the food included in the ambient image of the door and storing.

In accordance with another aspect of the present disclosure, a method of controlling a food storage apparatus capable of communicating with an external terminal includes sensing an object which approaches a door, transmitting an object approach signal to the terminal when an object which approaches the door within a preset distance, capturing an ambient image of the door, and transmitting the captured ambient image of the door to the terminal.

The method may further include locking the door when the object which approaches the door within the preset distance is sensed.

The food storage apparatus may include one of a display unit and a speaker. Here, the method may further include controlling one of the display unit and the speaker to output a warning which reports that the approach is unauthorized.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the attached drawings.

A food storage apparatus according to one embodiment of the present disclosure is an apparatus which stores food, and the food stored in the food storage apparatus includes food ingredients, beverages, alcoholic beverages, etc. but a type of the food is not limited thereto.

The food storage apparatus according to one embodiment of the present disclosure may keep food at an optical temperature by controlling a temperature therein. However, hereinafter, for a detailed description, a refrigerator which keeps wine contained in a bottle will be described.

Figure 1:
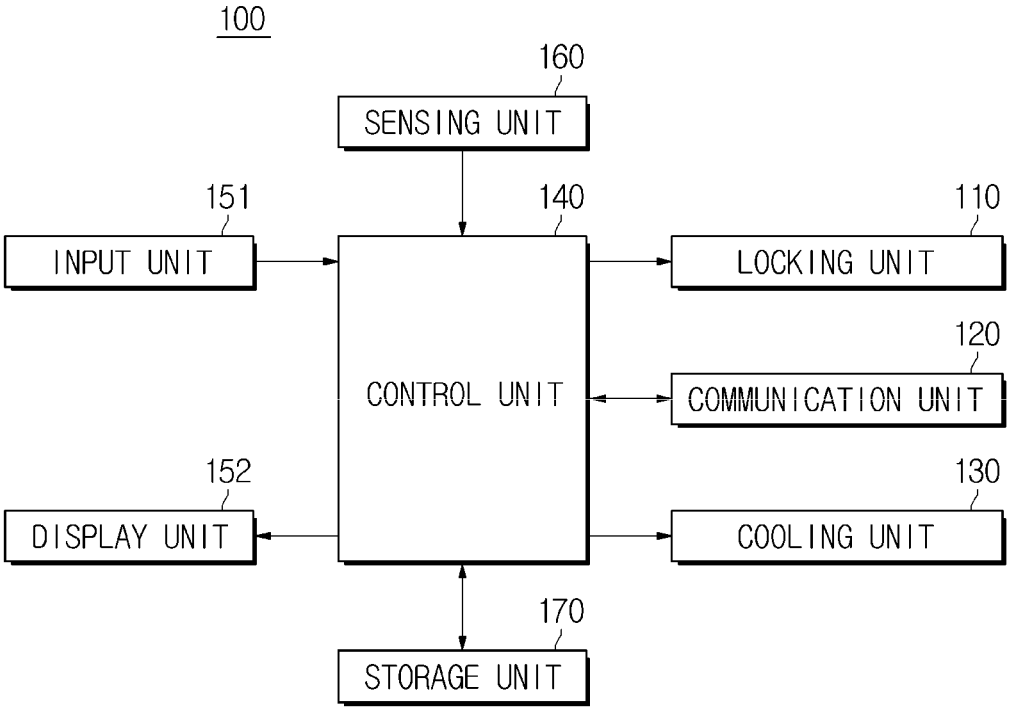
FIG. 1 is a control block diagram of a refrigerator according to one embodiment of the present disclosure.
Figure 2:
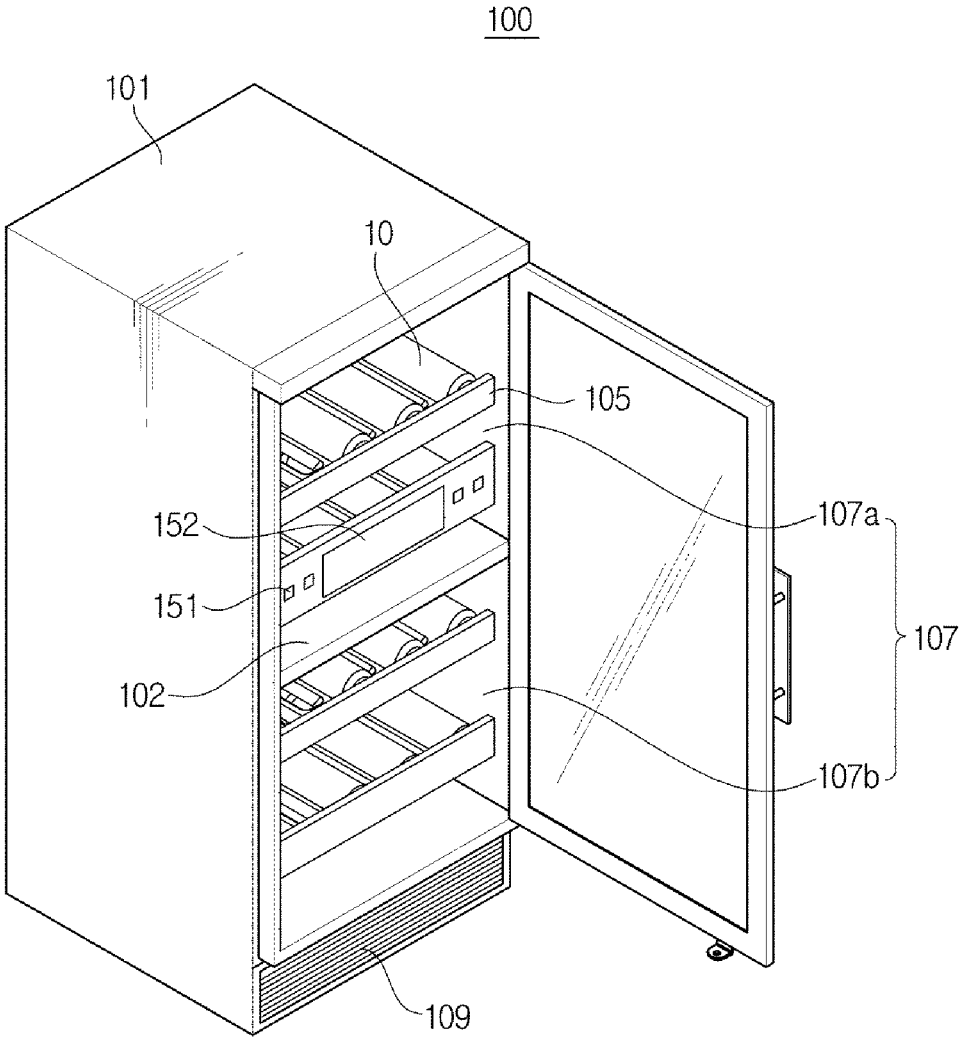
FIGS. 2 and 3 are views of the exterior of the refrigerator according to one embodiment of the present disclosure.
Figure 3:
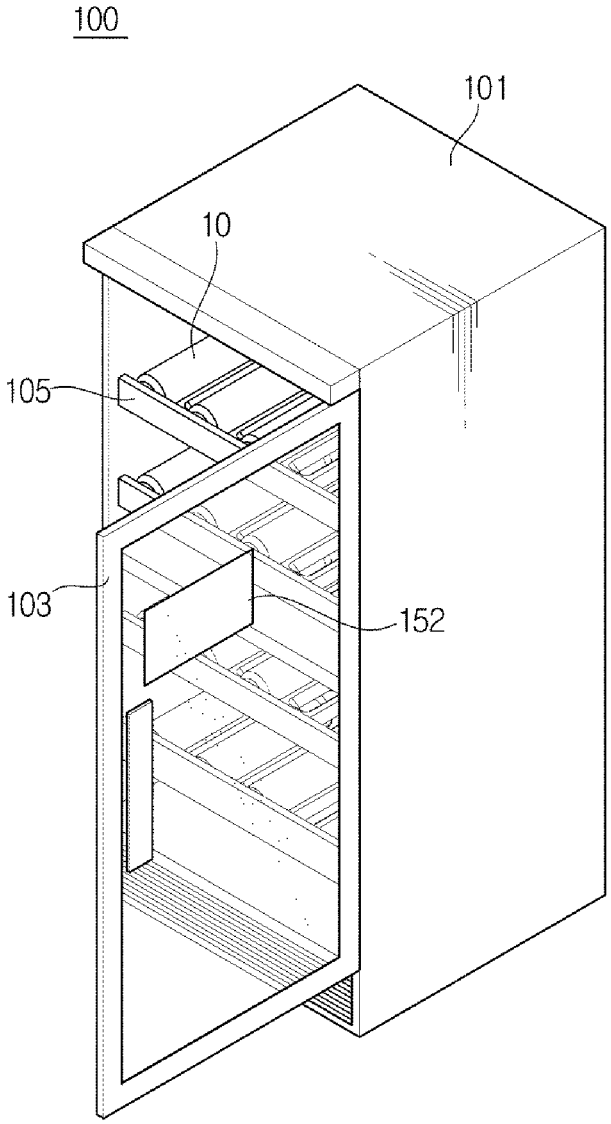

FIG. 1 is a control block diagram of a refrigerator according to one embodiment of the present disclosure. FIGS. 2 and 3 are views of the exterior of the refrigerator according to one embodiment of the present disclosure.

Referring to FIGS. 1 to 3, a refrigerator 100 according to one embodiment of the present disclosure includes a locking unit 110 which locks or unlocks a door 103, a communication unit 120 which communicates with a terminal, a cooling unit 130 which supplies cooling air to a storage space 107 in the refrigerator 100, a sensing unit 160 which senses opening and closing of the door 103, an input unit 151 which receives a control command input by a user, a display unit 152 which displays state information of the refrigerator 100, a screen for guiding an input of the control command, etc., and a control unit 140 which controls an operation of the refrigerator 100 according to a sensing result of the sensing unit 160, the control command input to the input unit 151, or a control command received through the communication unit 120.

The storage space 107 in which wine is stored is formed inside a body 1 which forms an exterior. In the storage space 107, a plurality of racks 105 which stores a plurality of wine bottles 10. Since wine is generally kept contained in a bottle, in the following embodiments, wine refers to wine contained in a bottle.

Also, a machine room 109 may be formed at a bottom unit of the body 101, and the cooling unit 130 which generates cool air to be supplied to the storage space 107 may be installed in the machine room 109.

The cooling unit 130 may maintain temperature of the storage space 107 within a certain range using evaporation of refrigerants. For example, the cooling unit 130 may supply cool air to the storage space 107 using a phenomenon in which a liquid refrigerant is decompressed and converted into a gas state and absorbs heat energy of ambient air. Otherwise, air inside the storage space 107 may be cooled using Peltier effect. Otherwise, the cooling unit 130 may maintain the temperature of the storage space 107 using magneto-caloric effect. In the corresponding embodiment, there is no limit to the method by which the cooling unit 130 cools or maintains the temperature of the storage space 107.

The storage space 107 of the body 1 may be divided into an upper storage space 107*a* and a lower storage space 107*b* by a partition wall 102. Since the upper storage space 107*a* and the lower storage space 107*b* are divided by the partition wall 102, air in the different spaces may be cooled and maintained at different temperatures due to the cooling unit 130.

Since a temperature for maintaining an optimal state may be different according to type of wine, temperature of each of the upper storage space 107*a* and the lower storage space 107*b* is optimally maintained for different types of wine in such a way that the user may separately keep wine according to type.

For example, it is known that red wine is optimally kept at about 14° C. to 18° C. and white wine is optimally kept at about 8° C. to 13° C. to maintain taste and flavor. Accordingly, the temperature inside the upper storage space 107*a* may be maintained at 14° C. to 18° C. to keep red wine and the temperature inside the lower storage space 107*b* may be maintained at 8° C. to 13° C. to keep white wine, thereby keeping the red wine and the white wine in optimal environments.

Otherwise, the temperature inside the upper storage space 107*a* may be maintained at a temperature optimal for white wine to keep white wine and the temperature inside the lower storage space 107*b* may be maintained at a temperature optimal for red wine to keep red wine.

The temperatures inside the upper storage space 107*a* and the lower storage space 107*b* are settable and changeable by the user.

A front side of the body 101 is open to put in or take out the wine bottle 10, and the door 103 is installed at the opened front side. The door 103 is pivotably installed, and the user may open and close the door by allowing the door 103 to pivot. Although it is shown that one door 103 is provided in FIG. 2, the door 103 may be provided at each of upper side and lower side to independently open and close the upper storage space 107*a* and the lower storage space 107*b* and also may be provided a double door.

The door 103 may be transparently provided for checking wine kept inside or the display unit 152 provided inside, from the outside. However, the transparent door 103 is merely an example applicable to the refrigerator 100 and the door 103 may be provided opaquely.

The display unit 152 may provide information on the refrigerator 100 or information on the wine kept inside the refrigerator 100. For example, the display unit 152 may display the information on the refrigerator 100 such as the temperature of the storage space 107 or basic information for user's convenience, such as weather, date, and time. Otherwise, information on wine presently kept may be displayed or, as described below, information on a security function of the refrigerator 100 may be displayed.

The display unit 152 may be embodied as a liquid crystal display (LCD) panel, a light emitting diode (LED) panel, an organic light emitting diode (OLED), etc.

The input unit 151 may receive a control command from the user. For example, the input unit 151 may receive control commands for turning on/off power of the refrigerator 100, setting the temperature inside the storage space 107, locking/unlocking the door 103, setting/releasing a security mode, searching for wine kept, etc.

The input unit 151 may be embodied as a button type as shown in FIG. 2 or may be embodied as a touch panel to form a touch screen together with the display unit 152. Here, the user may input a control command by touching a screen displayed by the display unit 152.

The display unit 152 and the input unit 151 may be installed inside the body 101 as shown in FIG. 2 and may be installed outside the body 101 as shown in FIG. 3. In detail, the display unit 152 and the input unit 151 may be installed on the rack 105 as shown in FIG. 2 or may be installed on the door 103 as shown in FIG. 3. In FIG. 3, the display unit 152 and the input unit 151 are embodied as a touch screen.

Since it is necessary to open the door 103 to operate the input unit 151 when the input unit 151 is installed on the rack 105, an arbitrary operation by an unauthorized person may be prevented. When the input unit 151 is installed on the door 103, a necessary input before authorizing the opening of the door 103, such as inputting a password for unlocking the door 103 or an unlocking request to be transmitted to the terminal 200, may be received.

Also, a part of the input unit 151 may be installed on the rack 105 or another part may be installed on the door 103. For example, the input of the password for unlocking the door 103 or the input of the unlocking request may be received by an input unit installed outside the body 101, and control commands for setting a temperature, searching for wine, setting/releasing the security mode, etc. may be received by an input unit installed inside the body 101.

The control unit 140 may control the refrigerator 100 according to a control command input through the input unit 151. For example, when a command for turning on/off the power of the refrigerator 100 is input through the input unit 151, the control unit 140 may turn on/off the power of the refrigerator 100. Also, when a temperature setting command is input through the input unit 151, the control unit 140 may cool air inside the storage space 107 according to an input temperature by controlling the cooling unit 130. Also, when a door locking command is input through the input unit 151 or a door locking command is received through the communication unit 120, the control unit 140 may lock the door 103 by controlling the locking unit 110. When an unlocking command is input or received, the control unit 140 may unlock the door 103. A configuration of the locking unit 110 for locking of the door 103 will be described below.

The sensing unit 160 may include a door sensor which senses opening and closing of the door 103 in a contact or contactless manner. When the opening and closing of the door 103 is sensed in a contact manner, a contact switch such as a micro switch, a limit switch, a touch switch, etc. may be employed. Otherwise, when the opening and closing of the door 103 is sensed in a contactless manner, one of a proximity switch, a photoelectric sensor, and an ultrasonic sensor may be employed, or a mechanical sensor installed on a component such as a hinge which pivotably connects the door 103 to the body 101 may be employed.

A sensing result of the sensing unit 160, that is, an output value of a door sensor may be sent to the control unit 140. The control unit 140 may control the locking unit 110 or may transmit a reporting message to the terminal through the communication unit 120 based on whether the door 103 is open.

The control unit 140 may include a program for performing the operations described above and operations to be described below, a memory which stores data necessary for executing the program, and a processor which executes the stored program. The control unit 140 may share a memory of a storage unit 170 or may use a memory separate from the storage unit 170.

The storage unit 170 may include at least one of nonvolatile memories such as a flash memory, a read-only memory (ROM), an erasable programmable ROM (EPROM), an electrically EPROM (EEPROM), etc. and may further include at least one of volatile memories such as a random access memory (RAM), a static RAM (S-RAM), a dynamic RAM (D-RAM), etc.

The nonvolatile memory may be used as an auxiliary memory device of the volatile memory and may maintain stored data even when the power of the refrigerator 100 is turned off. For example, the nonvolatile memory may store information on an appropriate temperature of the storage space 107, information on the terminal connected to the refrigerator 100, etc. and may store the program executed by the processor of the control unit 140 when the memory is shared with the control unit 140.

The volatile memory, unlike the nonvolatile memory, may lose stored data when the power of the refrigerator 100 is disconnected. The volatile memory may load and temporarily store a program and control data from the nonvolatile memory or may temporarily store a control signal output from the processor or an intermediate calculation value output during executing the program.

FIGS. 4A, 4B, 5A to 5C, and 6A and 6B are views illustrating examples of the locking unit installed in the refrigerator according to one embodiment of the present disclosure.

Figure 4A:
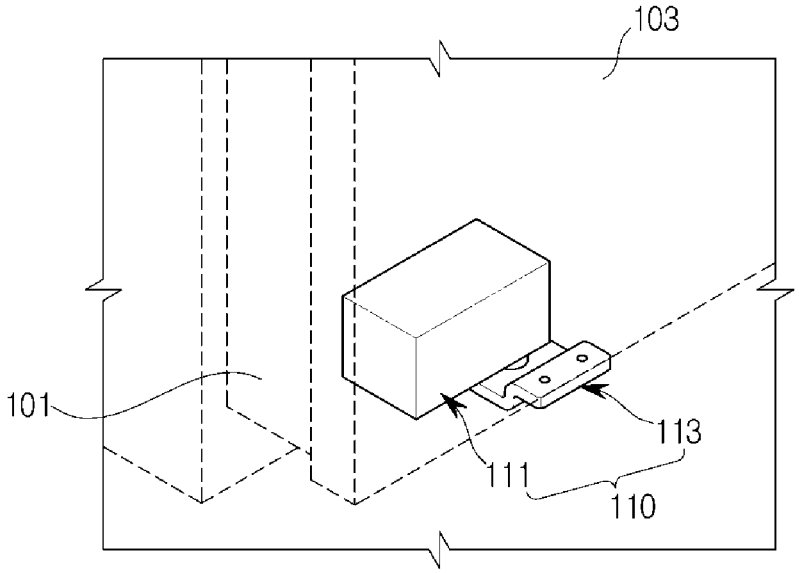
FIGS. 4A, 4B, 5A to 5C, and 6A and 6B are views illustrating examples of a locking unit installed in the refrigerator according to one embodiment of the present disclosure.
Figure 4B:
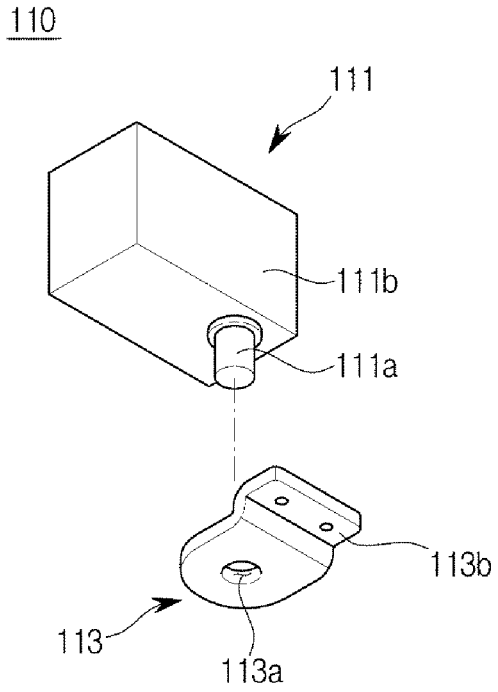

As an example, as shown in FIGS. 4A and 4B, the locking unit 110 may include a locking module 111 installed in the body 101 and a bracket 113 installed in the door 103. The locking module 111 includes a shaft 111*a* which moves upward and a motor module 111*b* which provides power to the shaft 111*a*. In the motor module 111*b*, a locking motor, a driving circuit for driving the locking motor, etc. may be built. The shaft 111*a* may linearly move and may spirally move. There is no limit in a movement path of the shaft 111*a*.

The shaft 111*a* moves downward to protrude outside of the motor module 111*b* and passes through a holding hole 113*a* of the bracket 113 to be inserted therein. When the shaft 111*a* passes through and is inserted in the holding hole 113*a*, the motor module 111*b* and the bracket 113 become a coupled state. In the coupled state, the door 103 does not open. This state may be considered a locked state of the door 103.

On the contrary, when the shaft 111*a* moves upward and is separated from the holding hole 113*a*, the motor module 111*b* and the bracket 113 become an uncoupled state. In the uncoupled state, the door 103 may be opened. This state may be considered an unlocked state of the door 103.

Rotation of the locking motor may be controlled by the control unit 140. When the control unit 140 transmits a locking signal to the locking module 111, the locking motor may rotate and insert the shaft 111*a* into the holding hole 113*a*. When the control unit 140 transmits an unlocking signal to the locking module 111, the locking motor may rotate backward and may separate the shaft 111*a* from the holding hole 113*a*.

Figure 5A:
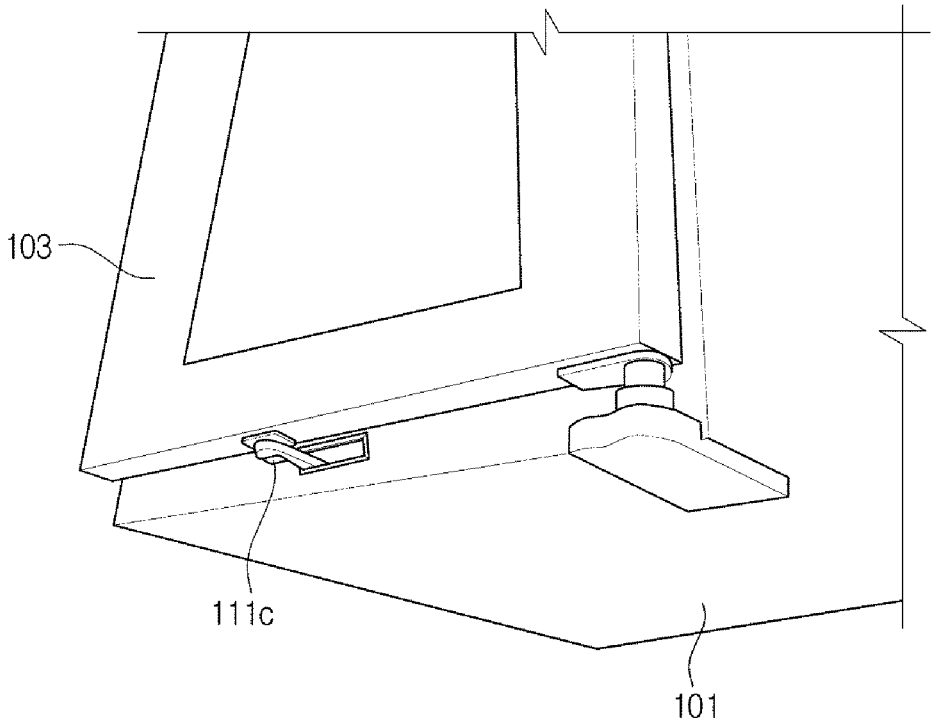
Figure 5B:
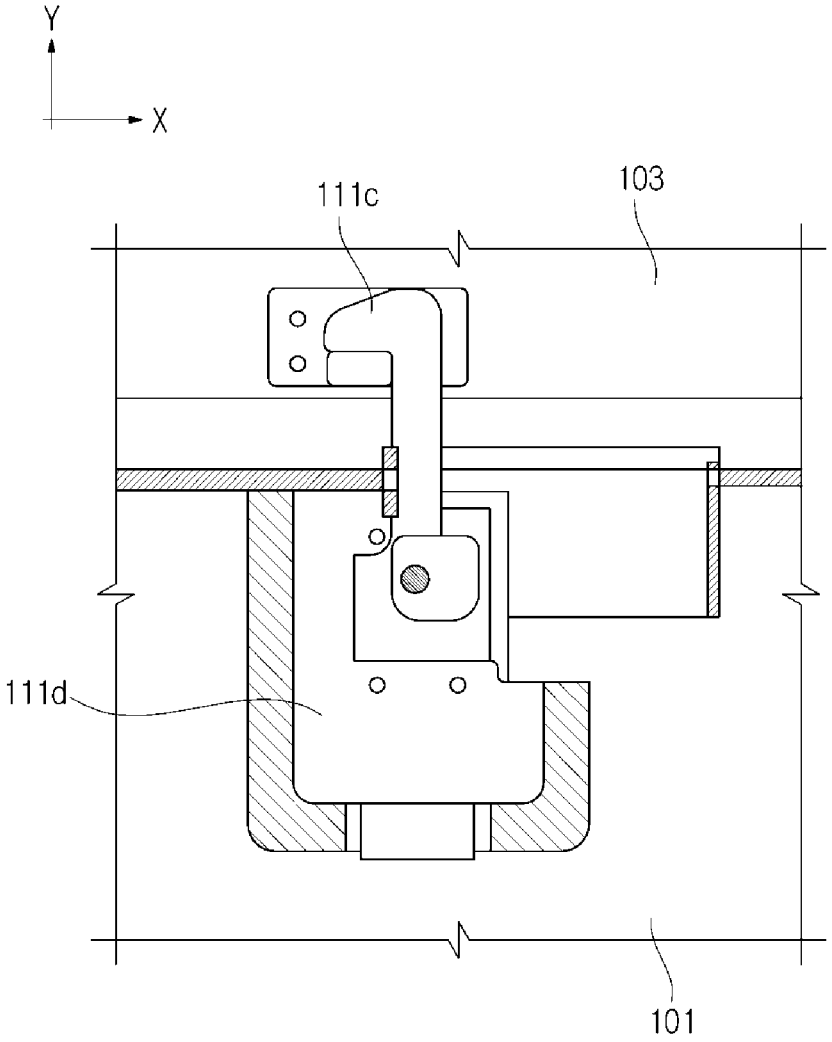
Figure 5C:
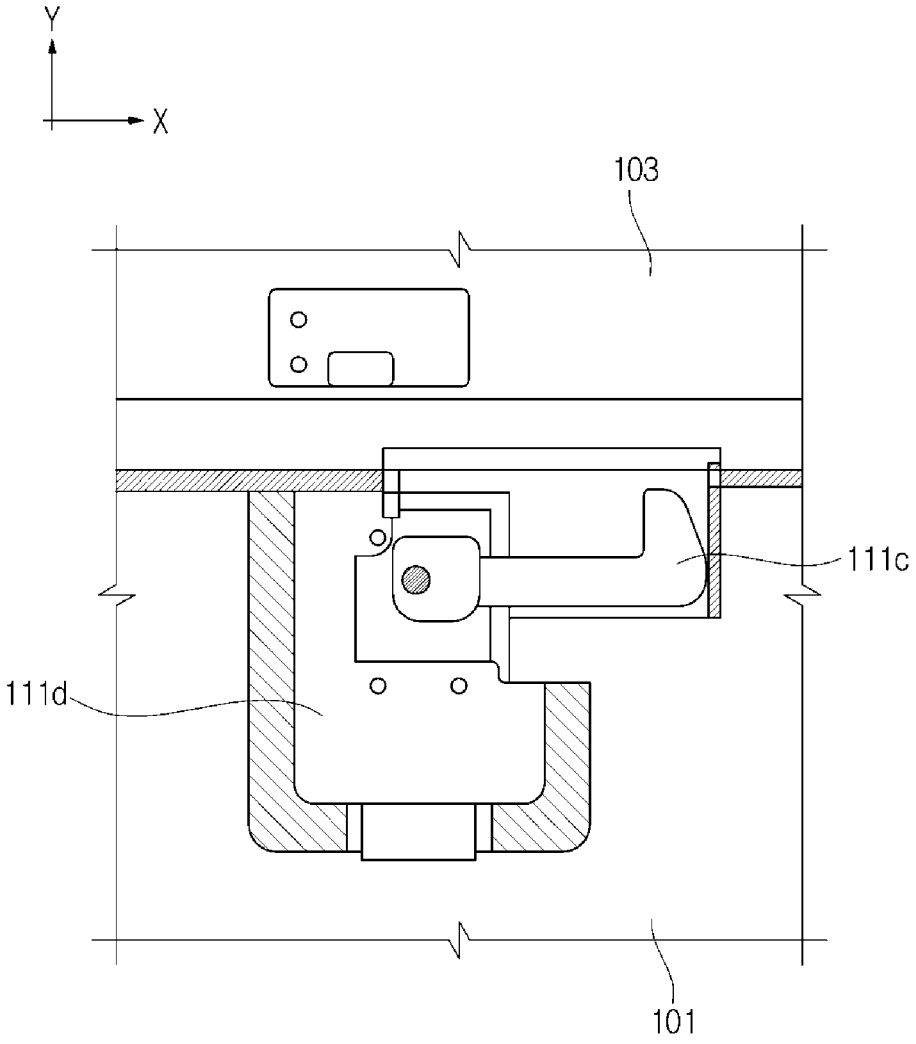

In another example, as shown in FIGS. 5A to 5C, the locking module 111 installed in the body 101 includes a hook 111*c* which pivots in a direction horizontal to the ground, and a motor module 111*d* and a holding protrusion 113*b* capable of being coupled with the hook 111*c* may be installed on the door 103. In the motor module 111*d*, a locking motor, a driving circuit for driving the locking motor, etc. may be built. The hook 111*c* may receive power from the locking motor to pivot.

FIGS. 5A and 5B are views illustrating a position of the hook 111*c* in the locking state. As shown in FIGS. 5A and 5B, when the hook 111*c* pivots toward y axis and then is held by the holding protrusion 113*b* installed on the door 103. The door 103 does not open in a state in which the hook 111*c* is held by the holding protrusion 113*b*. This state may be considered as a locked state of the door 103.

As shown in FIG. 5C, when the hook 111*c* pivots toward x axis, the hook 111*c* is separated from the holding protrusion 113*b*. The door 103 is opened in a state in which the hook 111*c* is separated from the holding protrusion 113*b*. This state may be considered as an unlocked state of the door 103.

In the example, the locking module 111 and the holding protrusion 113*b* are installed at bottom end of the refrigerator 100. However, examples of the refrigerator 100 are not limited thereto. The locking module 111 and the holding protrusion 113*b* may be installed on a side or upper end of the refrigerator 100.

Figure 6A:
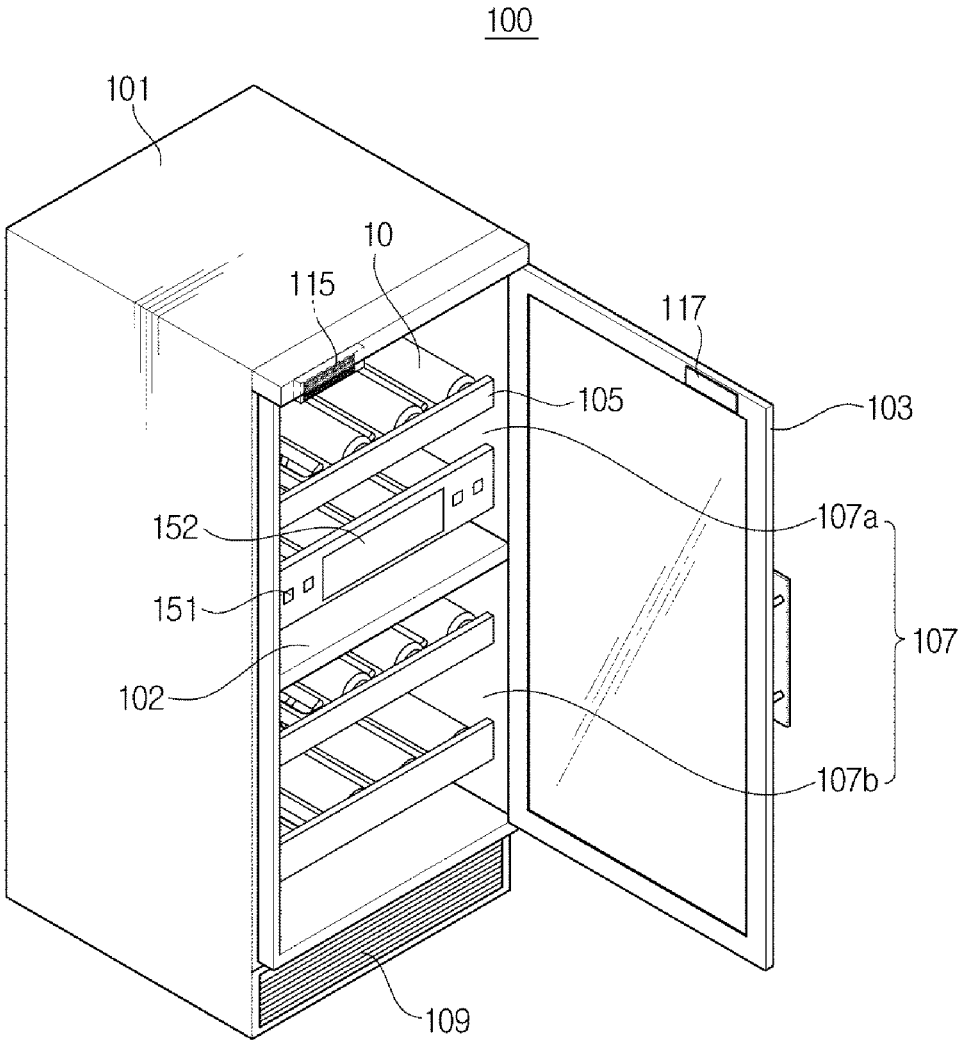
Figure 6B:
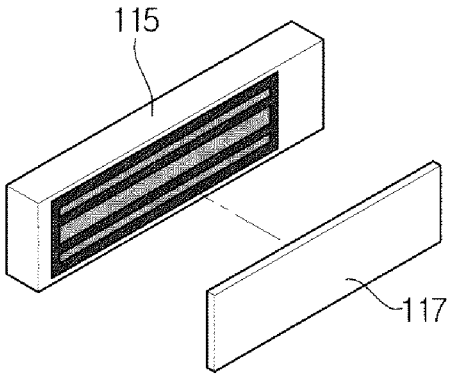

As still another example, the locking unit 110, as shown in FIGS. 6A and 6B, may include an electromagnet module 115 installed on the body 101 and a magnet 117 installed on the door 103. On the contrary, the magnet 117 may be installed on the body 101 and the electromagnet module 115 may be installed on the door 103. Also, in FIG. 6B, the electromagnet module 115 and the magnet 117 are installed at the upper end of the refrigerator 100. However, examples of the refrigerator 100 are not limited thereto. The electromagnet module 115 and the magnet 117 may be installed at lower end or a side of the refrigerator 100.

The electromagnet module 115 may include an electromagnet magnetized by power supplied from the outside to have different polarities and a switch which switches the power supplied to the electromagnet. When the electromagnet is magnetized as the same polarity as the magnet 117, the unlocked state results in which the door 103 may be opened. When the electromagnet is magnetized as the opposite polarity to the magnet 117, the locked state results in which the door 103 is bound not to be opened due to attractive force between the electromagnet and the magnet 117.

Meanwhile, the control unit 140 may transmit a control signal to the locking unit 110 according to a control command input through the input unit 151, may transmit a control signal to the locking unit 110 according to a control command received from the terminal, and may transmit a control signal to the locking unit 110 by autonomous determination based on a sensing result of the sensing unit 160.

The control unit 140 may permit opening of the door 103 to a person authorized to open the door 103. Whether a person is authorized may be determined based on an input of a password or a security code, near field communication (NFC), radio frequency identification (RFID) recognition, etc.

For example, when an unlocking command is input through the input unit 151, the control unit 140 may transmit an unlocking signal to the locking unit 110. The unlocking command may be input together with a password or a security code in advance. The control unit 140 may transmit the unlocking signal to the locking unit 110 when the input password or security code is identical to a preset password or security code.

As another example, the sensing unit 160 may include a recognition device such as an NFC reader, an RFID reader, etc. and may read an NFC or RFID chip which approaches the refrigerator 100 and may transmit a reading result to the control unit 140. The NFC or RFID chip may be built in the terminal such as smart phone or may be built in a separate smart key for opening and closing the refrigerator 100. The control unit 140 may transmit the unlocking signal to the locking unit 110 when the reading result is identical to prestored information.

Figure 7:
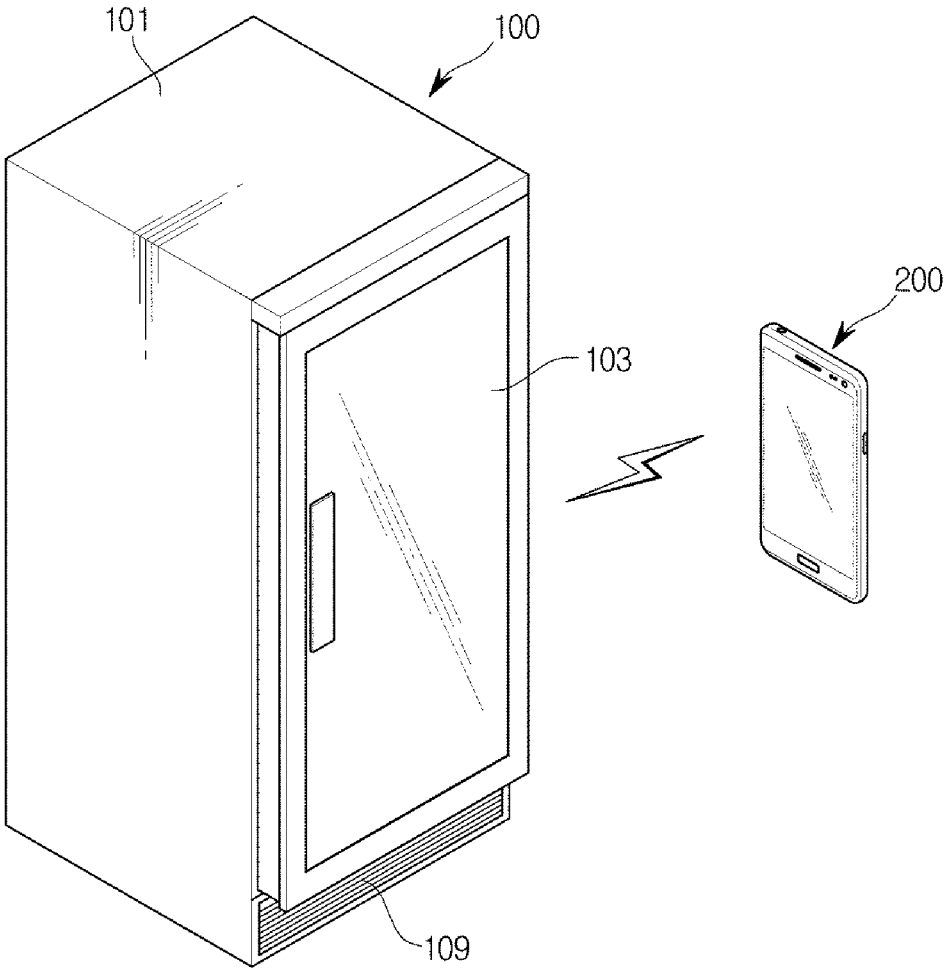
FIG. 7 is a view of a terminal which communicates with the refrigerator according to one embodiment of the present disclosure.
Figure 8:
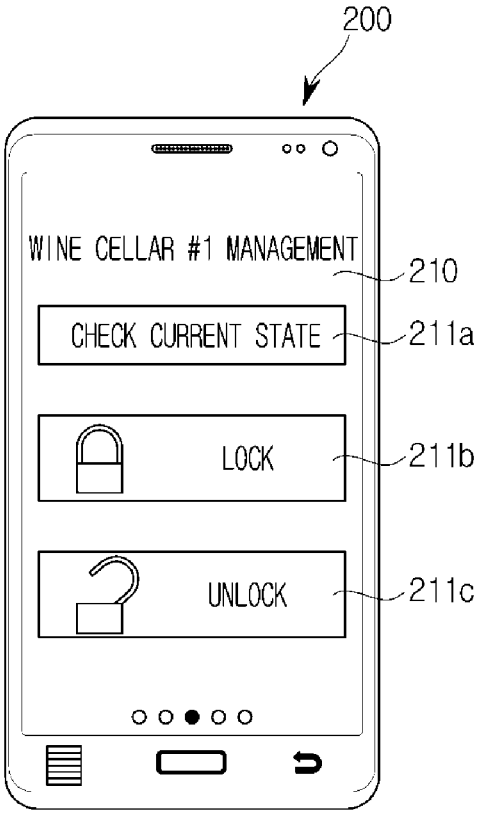
FIGS. 8 and 9 are views illustrating examples of a screen displayed on the terminal.
Figure 9:
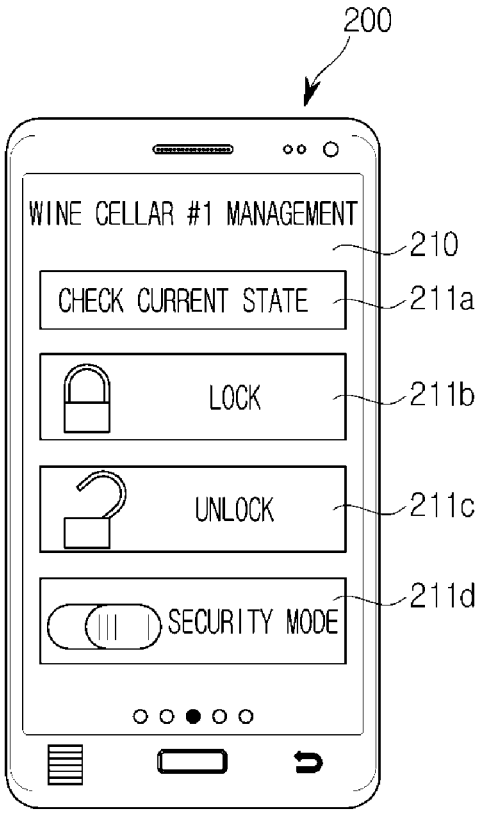

FIG. 7 is a view of the terminal which communicates with the refrigerator according to one embodiment of the present disclosure. FIGS. 8 and 9 are views illustrating examples of a screen displayed on the terminal.

Referring to FIG. 7, the refrigerator 100 may transmit and receive signals with the terminal 200 through the communication unit 120.

The communication unit 120 may include a local area communication module and a wireless communication module.

The local area communication module means a module for performing local area communication with an apparatus positioned at certain distances. A local area communication technology applicable to one embodiment includes wireless local area network (LAN), Bluetooth, Zigbee, wireless fidelity direct (Wi-Fi) (WFD), ultra wideband (UWB), infrared data association (IrDA), Bluetooth low energy (BLE), NFC, etc. but is not limited thereto.

The wireless communication module may include an antenna or a wireless communication chip for transmitting and receiving wireless signals with at least one of a base station, an external apparatus, and a server on a mobile communication network and may be, for example, a wireless communication module which supports wireless LAN standards of Institute of Electrical and Electronics Engineers (IEEE802.11x).

The terminal 200 is an electronic device such as a smart phone, a smart watch, smart glasses, personal digital assistants (PDA), a personal computer (PC), etc. which performs wireless communication to be connected to another device.

The terminal 200 may receive information on a condition of the refrigerator 100 from the refrigerator 100 and may transmit a control command to the refrigerator 100 to control locking of the door 103, the temperature, and the display.

For this, the terminal 200 and the refrigerator 100 may be mutually authorized. For example, a program for managing the refrigerator 100 may be installed in the terminal 200 and may be installed during the manufacturing of the terminal 200 or may be downloaded by the user from an external server after the terminal 200 is sold.

As an example, a method of inputting a password set in the refrigerator 100 into the terminal 200 for mutual authentication between the terminal 200 and the refrigerator 100. When the mutual authentication between the terminal 200 and the refrigerator 100 is completed, the terminal 200 may function as a remote control which controls the refrigerator 100 from a remote place.

When the program for managing the refrigerator 100 installed in the terminal is executed, a menu list necessary for managing the refrigerator 100 may be displayed on a display unit 210 of the terminal 200. For example, as shown in FIG. 8, a current state checking icon 211*a* for checking a current state of the refrigerator 100, a locking icon 211*b* for locking the door 103 of the refrigerator 100, and an unlocking icon 211*c* for unlocking the door 103 may be displayed.

When the user selects the current state checking icon 211*a*, information such as current temperature and locked state of the refrigerator 100, the number of wine bottles kept, a list of wine bottles kept, positions of wine bottles kept, etc. may be displayed on the display unit 210.

When the user selects the locking icon 211*b*, the terminal 200 may transmit a locking command to the refrigerator 100. When the user selects the unlocking icon 211*c*, the terminal 200 may transmit an unlocking command to the refrigerator 100.

Accordingly, the user may lock the door 103 using the terminal 200 even after going out with the door 103 unlocked and may unlock the door 103 as necessary even after going out with the door 103 locked.

Referring to FIG. 9, a security mode icon 211*d* for setting or releasing a security mode may be further displayed on the display unit 210 of the terminal 200.

When the user sets the security mode using the security mode icon 211*d*, operations for security are performed. When the security mode is released, a part or all of the ensuing operations are limited.

Hereinafter, operations of the refrigerator 100 and the terminal 200 for tightening security of wine will be described in detail.

Figure 10:
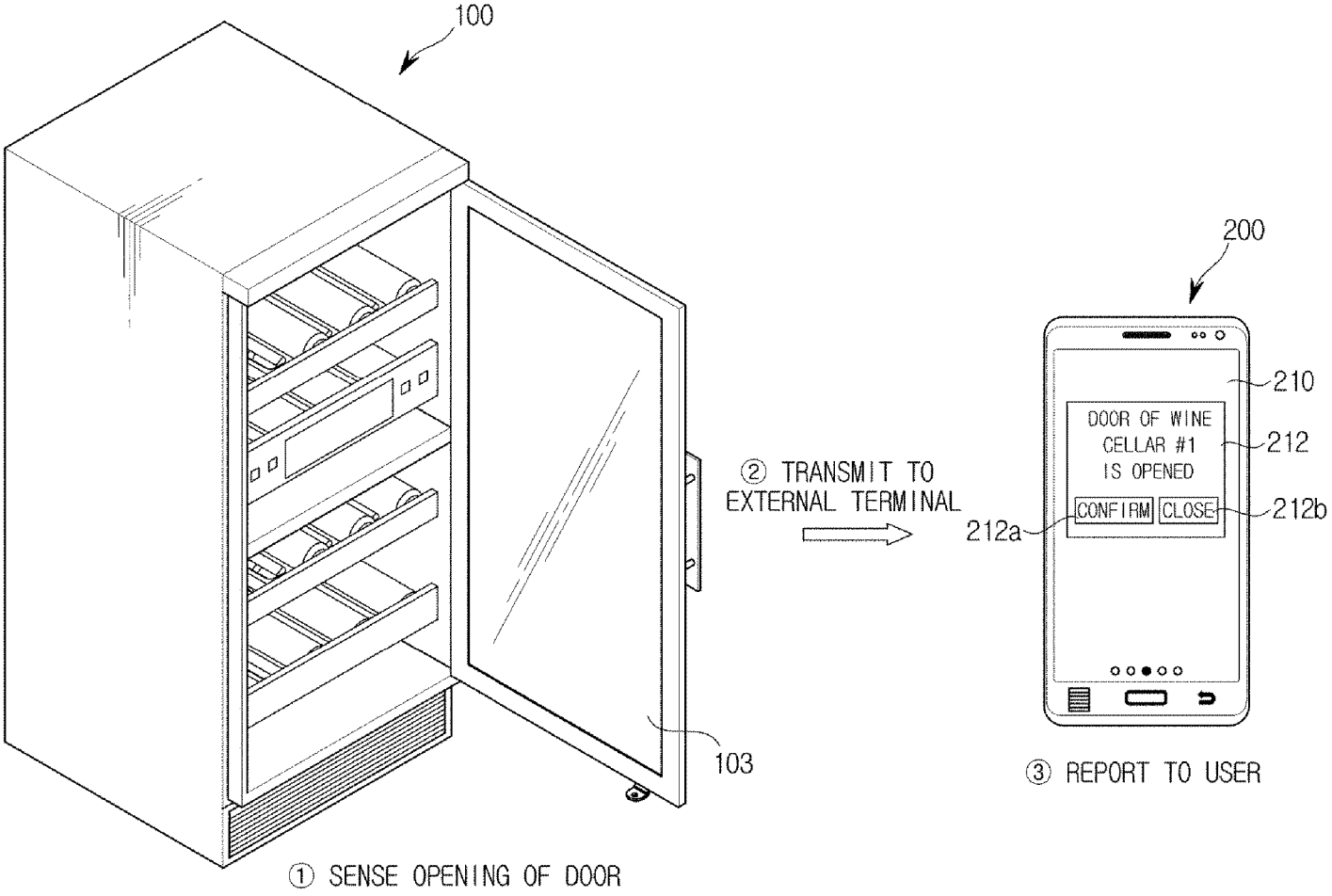
FIGS. 10 and 11 are views illustrating examples of signals transmitted from the refrigerator to the terminal when opening of a door is sensed.
Figure 11:
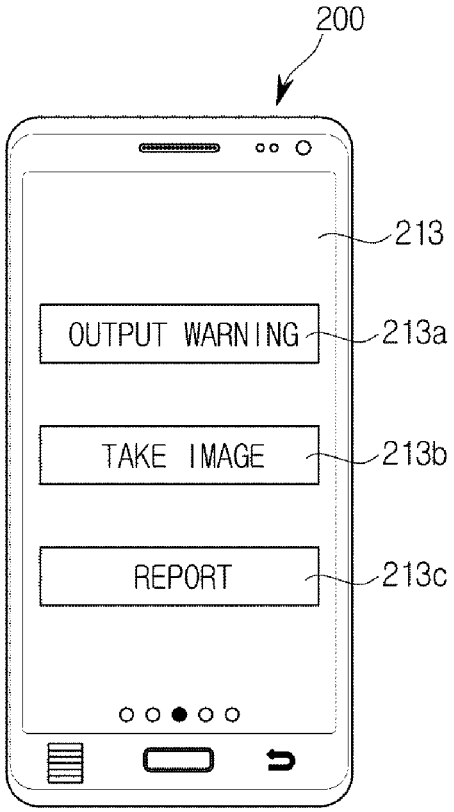

FIGS. 10 and 11 are views illustrating examples of signals transmitted from the refrigerator to the terminal when opening of a door is sensed.

As shown in FIG. 10, when the sensing unit 160 senses opening of the door 103 (①), a door opening sensing signal is transmitted to the control unit 140. The control unit 140 may transmit a door-open signal which reports that the door 103 is opened to the terminal 200 (②) through the communication unit 120.

The terminal 200 which receives the door-open signal may display a pop-up screen 212, on the display unit 210, to report that the opening of the door 103 is sensed.

A check icon 212*a* and a closing icon 212*b* may be displayed on the pop-up screen 212.

When the user selects the check icon 212*a*, as shown in FIG. 9, a corresponding screen 213 which guides taking measures against the opening of the door 103 may be displayed. For example, the corresponding screen 213 may include a warning output icon 213*a* which outputs a visual or an auditory warning message through the refrigerator 100, an image-capturing icon 213*b* which takes an ambient image of the refrigerator 100 using the image sensor as described below, and a reporting icon 213*c* which reports to the police. When the closing icon 212*b* is selected, the pop-up screen 212 disappears.

When the warning output icon 213*a* or the image-capturing icon 213*b* is selected, the terminal 200 may transmit a control command corresponding to the selected icon to the communication unit 120 of the refrigerator 100. When the reporting icon 213*c* is selected, a report signal may be transmitted to a previously registered agency.

The user may take measures against unauthorized opening of the door 103 by selecting an appropriate icon. The types of icons described above are merely examples applicable to the refrigerator 100 according to one embodiment of the present disclosure, and icons for other responses in addition to the examples may be further displayed. Also, the terminal 200 may merely report, to the user, that the door 103 is opened and an operation corresponding thereto may be autonomously performed by the refrigerator 100.

Meanwhile, the operations described above may be performed when the refrigerator 100 is set in the security mode. That is, when the door 103 is opened while the refrigerator 100 is set in the security mode, the opening is determined to be unauthorized opening and the operations described above are performed. When the security mode is released, the opening is determined to be authorized opening and the operations described above may be not performed.

Figure 12:
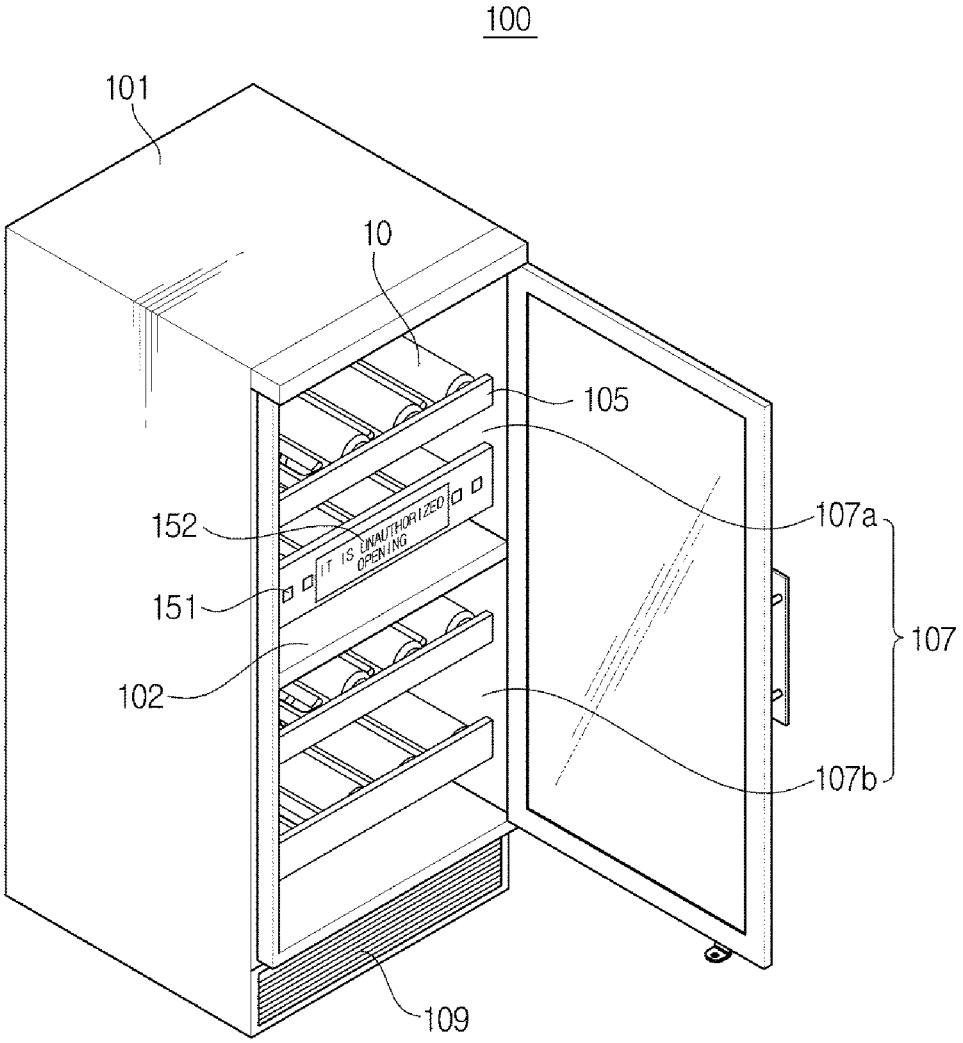
FIGS. 12 and 13 are views illustrating operations of a display unit when the door of the refrigerator is opened.
Figure 13:
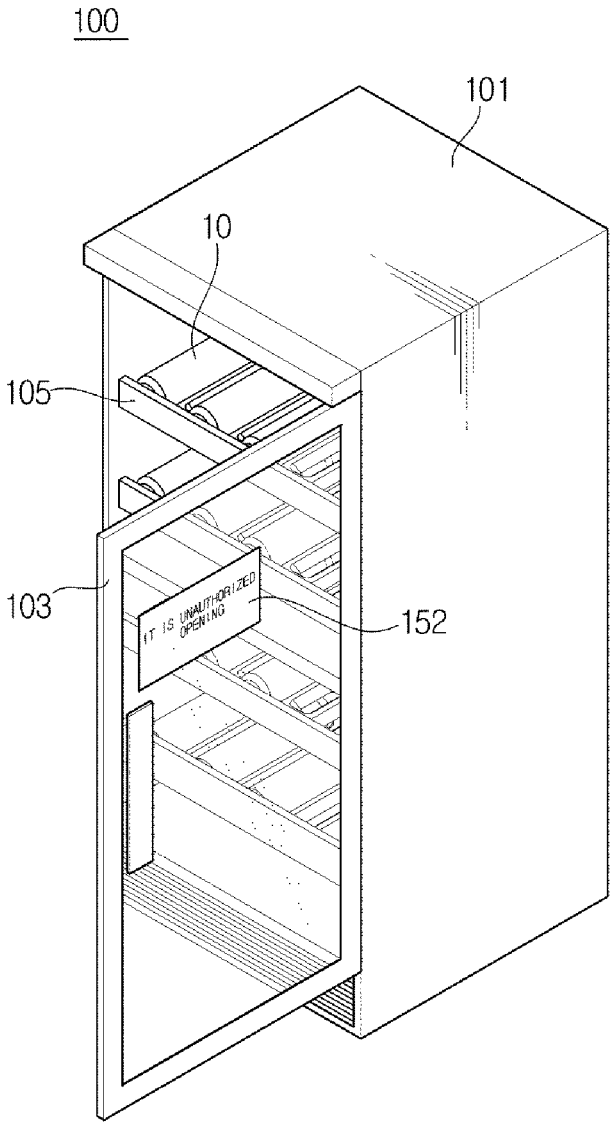

FIGS. 12 and 13 are views illustrating operations of the display unit when the door of the refrigerator is opened.

When the sensing unit 160 senses the opening of the door 103, as shown in FIGS. 12 and 13, the display unit 152 may output a visual warning message which reports that the opening is unauthorized.

The warning message, as described above with reference with FIG. 11, may be output according to a control command received from the terminal 200 or may be output autonomously, that is, automatically output by the control unit 140 which receives a door opening sensing signal from the sensing unit 160.

Figure 14:
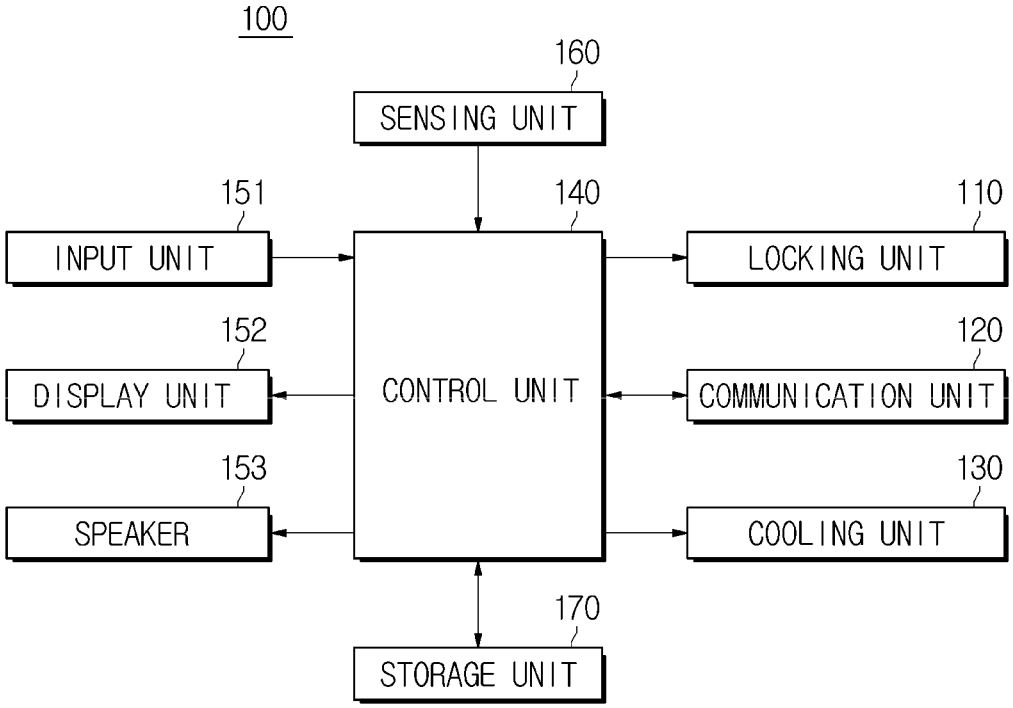
FIG. 14 is a control block diagram of the refrigerator which further includes a speaker.
Figure 15:
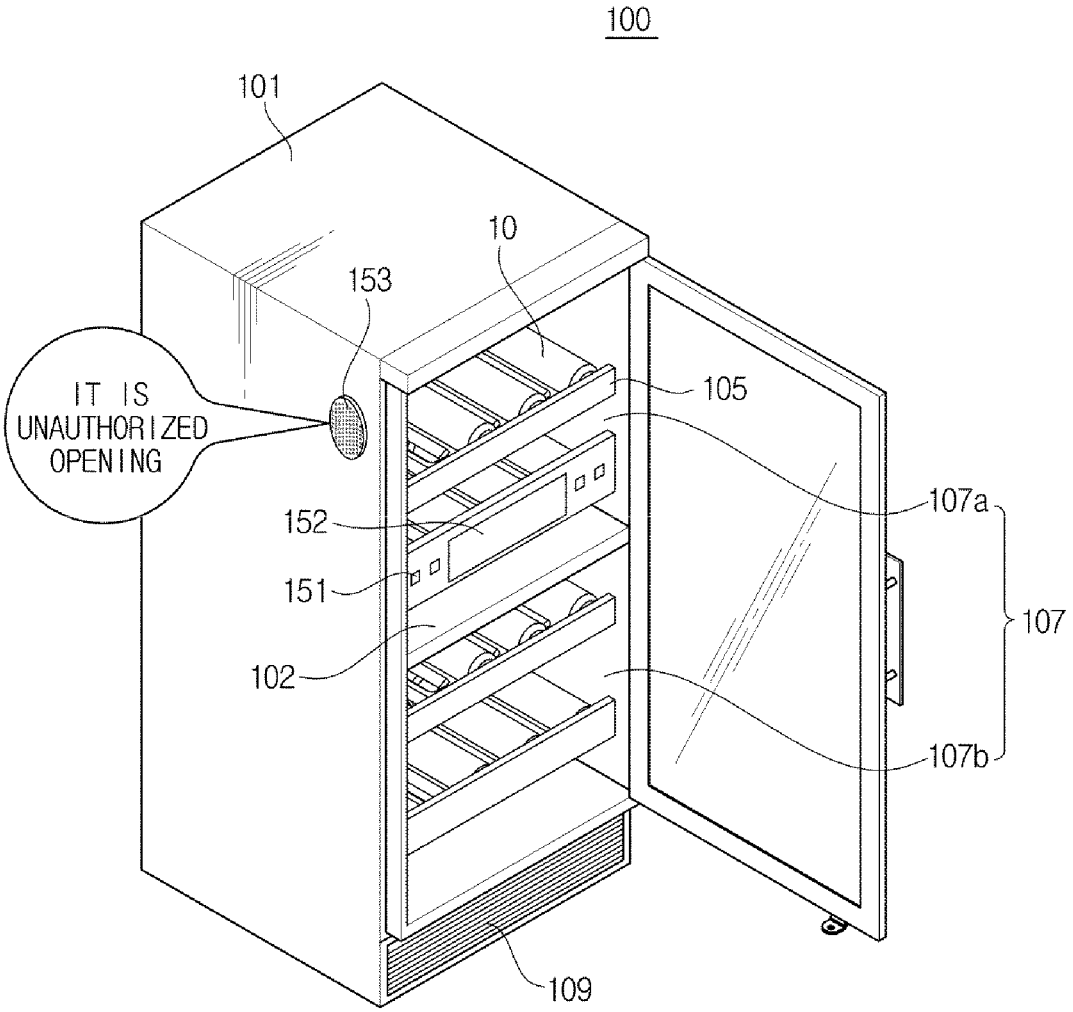
FIG. 15 is a view illustrating an operation of the speaker when the door of the refrigerator is opened.

FIG. 14 is a control block diagram of the refrigerator which further includes a speaker. FIG. 15 is a view illustrating an operation of the speaker when the door of the refrigerator is opened.

Referring to FIG. 14, the refrigerator 100 according to one embodiment of the present disclosure may further include a speaker 153 which outputs sound. The speaker 153 is installed outside the refrigerator 100 to allow the output sound to be heard from the outside.

When the sensing unit 160 senses opening of the door 103, as shown in FIG. 15, the speaker 153 may output an auditory warning message which reports that the opening is unauthorized.

Similarly, the warning message may be output according to a control command received from the terminal 200 or may be automatically output by the control unit 140 which receives a door opening sensing signal from the sensing unit 160.

Meanwhile, the visual and the auditory output of the message may be selectively performed or may be performed at the same time.

As shown in FIGS. 12 to 15, when a visual or auditory warning message is output according to unauthorized opening of the door 103, even when a person opens the door 103 with intent to steal wine bottles, the persona may recognize that the refrigerator 100 is in a security state and may give up stealing.

Figure 16:
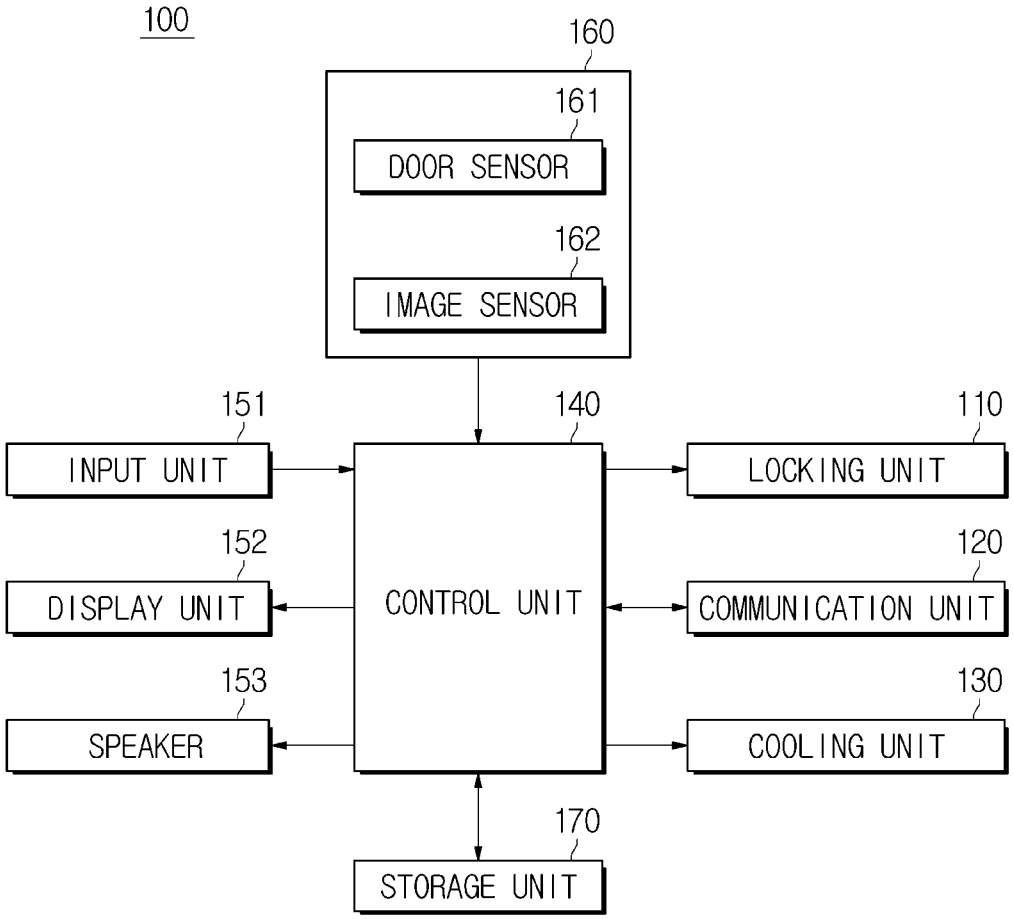
FIG. 16 is a control block diagram of the refrigerator which further includes an image sensor.
Figure 17:
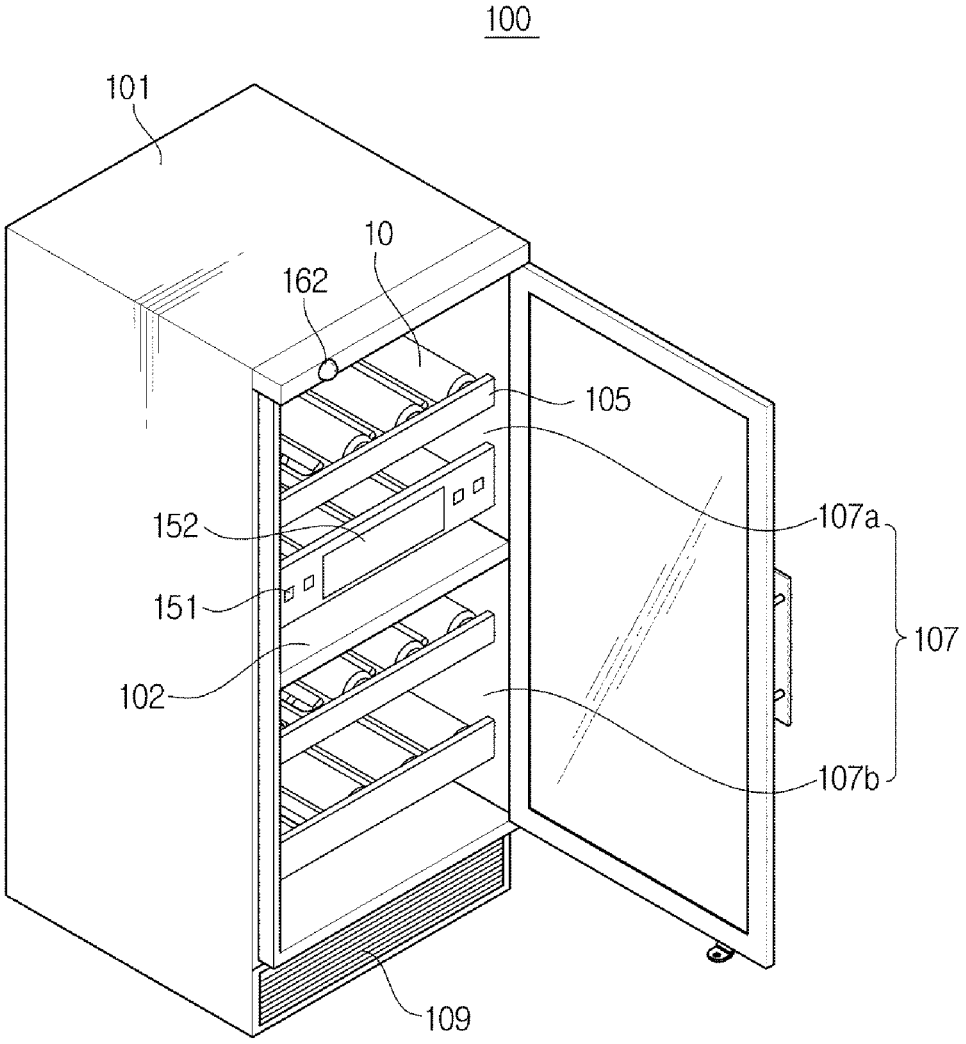
FIG. 17 is a view of the exterior of a refrigerator which further includes the image sensor.

FIG. 16 is a control block diagram of the refrigerator which further includes an image sensor. FIG. 17 is a view of the exterior of the refrigerator which further includes the image sensor.

Referring to FIG. 16, the refrigerator 100 according to one embodiment of the present disclosure may further include a camera, that is, an image sensor 162 which takes an ambient image of the refrigerator 100. The image sensor 162 may be a charge-coupled device (CCD) camera or a complementary metal-oxide semiconductor (CMOS) camera. Accordingly, the sensing unit 160 includes a door sensor 161 which senses opening and closing of the door 103 and the image sensor 162.

Referring to FIG. 17, the image sensor 162 may be installed on the exterior of the body 101 and, more particularly, may be installed toward front of the refrigerator 100 to take an image of a person who opens the door 103.

In FIG. 17, for example, the image sensor 162 is installed on top of the body 101, however, merely as an example applicable to the refrigerator 100 according to one embodiment of the present disclosure. In addition to the position shown in FIG. 17, the image sensor 162 may be installed at any position where it is possible to take an image of a person who opens the door 103.

Figure 18:
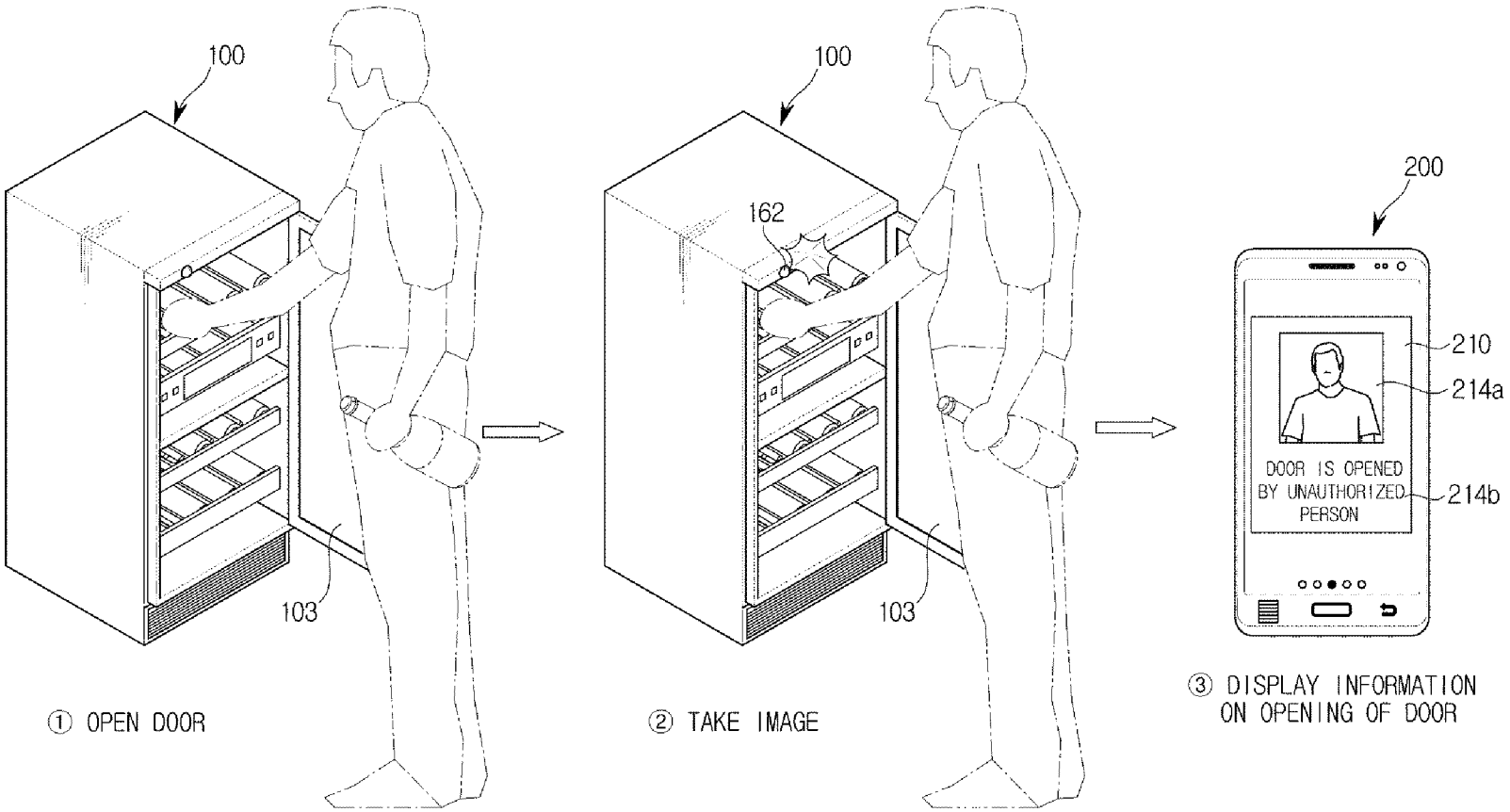
FIG. 18 is a view illustrating an operation of the image sensor which takes an ambient image of the refrigerator.

FIG. 18 is a view illustrating an operation of the image sensor which takes an ambient image of the refrigerator.

As shown in FIG. 18, when the door sensor 161 senses opening of the door 103 (①), a door opening sensing signal is transmitted to the control unit 140 and the control unit 140 turns on the image sensor 162. The image sensor 162 takes an ambient image of the refrigerator 100 (②), and the control unit 140 transmits the captured image to the terminal 200 through the communication unit 120. The face of a person who opens the door 103 may be included in the ambient image of the refrigerator 100.

The terminal 200 may display an ambient image 214*a* of the refrigerator 100 and a message 214*b* which reports that unauthorized opening of the door 103 is sensed on the display unit 210 (③).

Otherwise, as described with reference to FIGS. 10 and 11, the refrigerator 100 may transmit a door opening signal to the terminal 200, and when a control command for capturing an image is received from the terminal 200, the image sensor 162 may take an image and transmit the captured image to the terminal 200.

The user may check the face of the person who opens the door 103, may take measures such as reporting to the police as necessary or inputting a control command for outputting a warning message on the refrigerator 100 into the terminal 200, etc.

Figure 19:
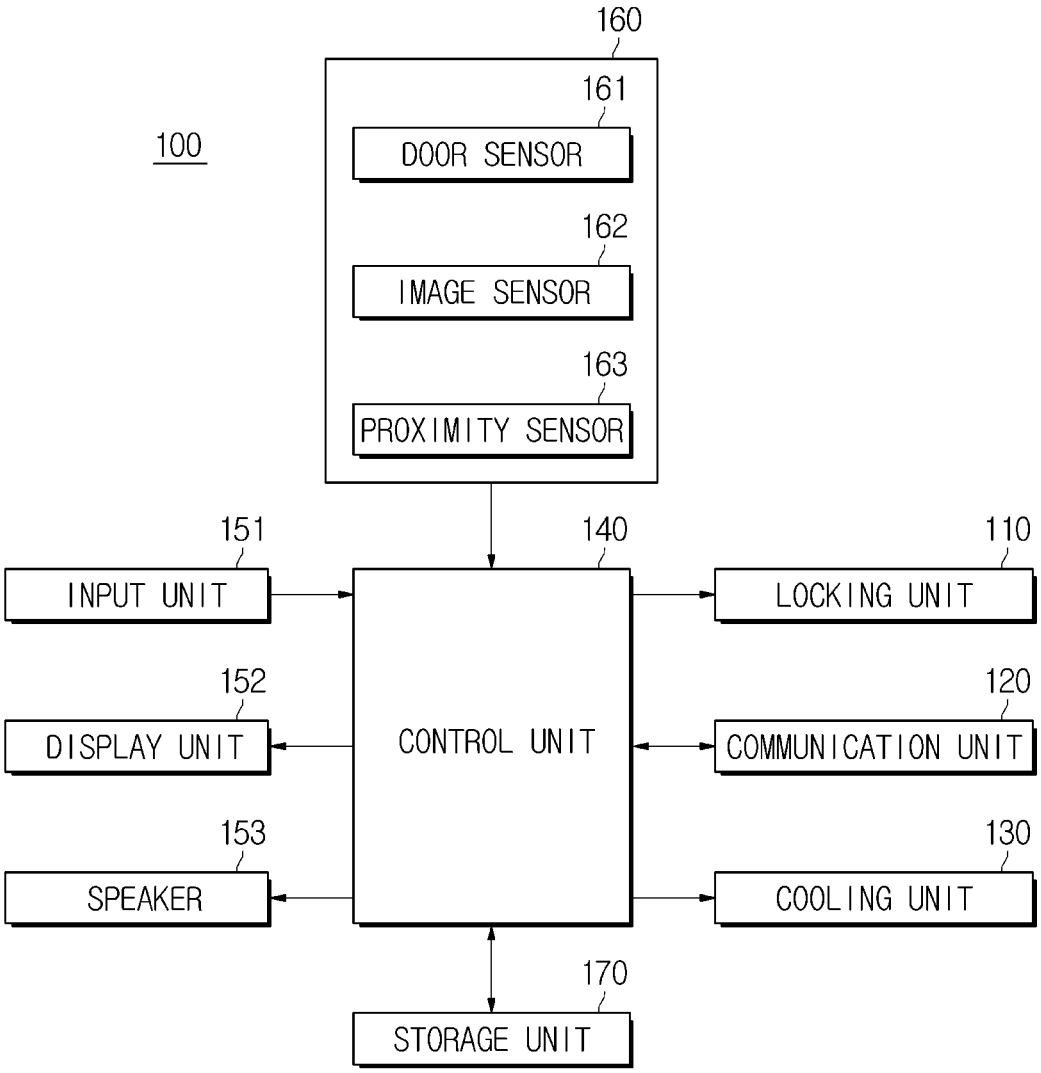
FIG. 19 is a control block diagram of the refrigerator which further includes a proximity sensor.

FIG. 19 is a control block diagram of the refrigerator which further includes a proximity sensor.

Referring to FIG. 19, the sensing unit 160 of the refrigerator 100 according to one embodiment of the present disclosure may further include a proximity sensor 163 which senses an object approaching the refrigerator 100.

The proximity sensor 163 may be embodied as one of an infrared (IR) sensor, an ultrasonic sensor, and an optical sensor. However, the sensors are merely examples applicable to the refrigerator 100 according to one embodiment of the present disclosure, and the type of the proximity sensor 163 is not limited thereto.

In detail, the proximity sensor 163 may transmit an approach sensing signal to the control unit 140 when an object which approaches within a preset distance is sensed. Particularly, the proximity sensor 163 may sense a human body.

As an example, when the proximity sensor 163 senses an object which approaches the refrigerator 100 within a preset distance, the control unit 140 may transmit a locking signal to the locking unit 110 to lock the door 103.

As another example, when the proximity sensor 163 senses an object which approaches the refrigerator 100 within a preset distance, the control unit 140 may control at least one of the display unit 152 and the speaker 153 to output a warning message.

As another example, when the proximity sensor 163 senses an object which approaches the refrigerator 100 within a preset distance, the control unit 140 may turn on the image sensor 162 to take an ambient image of the refrigerator 100. The captured image may be transmitted to the terminal 200.

As another example, when the proximity sensor 163 senses an object which approaches the refrigerator 100 within a preset distance, the control unit 140 may transmit an object approach signal to the terminal 200. Here, the terminal 200 may output a message which reports the approach of the object and the user may take adequate measures such as locking the door 103, outputting a warning message through the display unit 152 or the speaker 153, or capturing an ambient image of the refrigerator 100 using the image sensor 162, through the terminal 200.

As another example, operations of capturing an image, reporting to the terminal 200, outputting a warning message, and locking the door 103 may be sequentially performed. Here, all of the operations may be sequentially performed and a next operation may not be performed when the approaching object disappears. The order of the operations is not limited to the stated order.

Meanwhile, the security mode may be divided into a plurality of stages according to security levels. For example, there may be a first security mode, a second security mode, a third security mode, and a fourth security mode that may be set. When the first security mode is set, the object approach signal may be transmitted. When the second security mode is set, the image sensor 162 may take and transmit an image to the terminal 200. When the third security mode is set, warning messages may be output through the display unit 152 and the speaker 153. When the fourth security mode is set, the door 103 may be locked. Security becomes gradually tightened from the first security mode to the fourth security mode.

The above description is merely an example applicable to the refrigerator 100 according to one embodiment of the present disclosure, and the stages of the security mode may be partially omitted, other security modes may be further added, or operations performed for each stage may become different.

Figure 20:
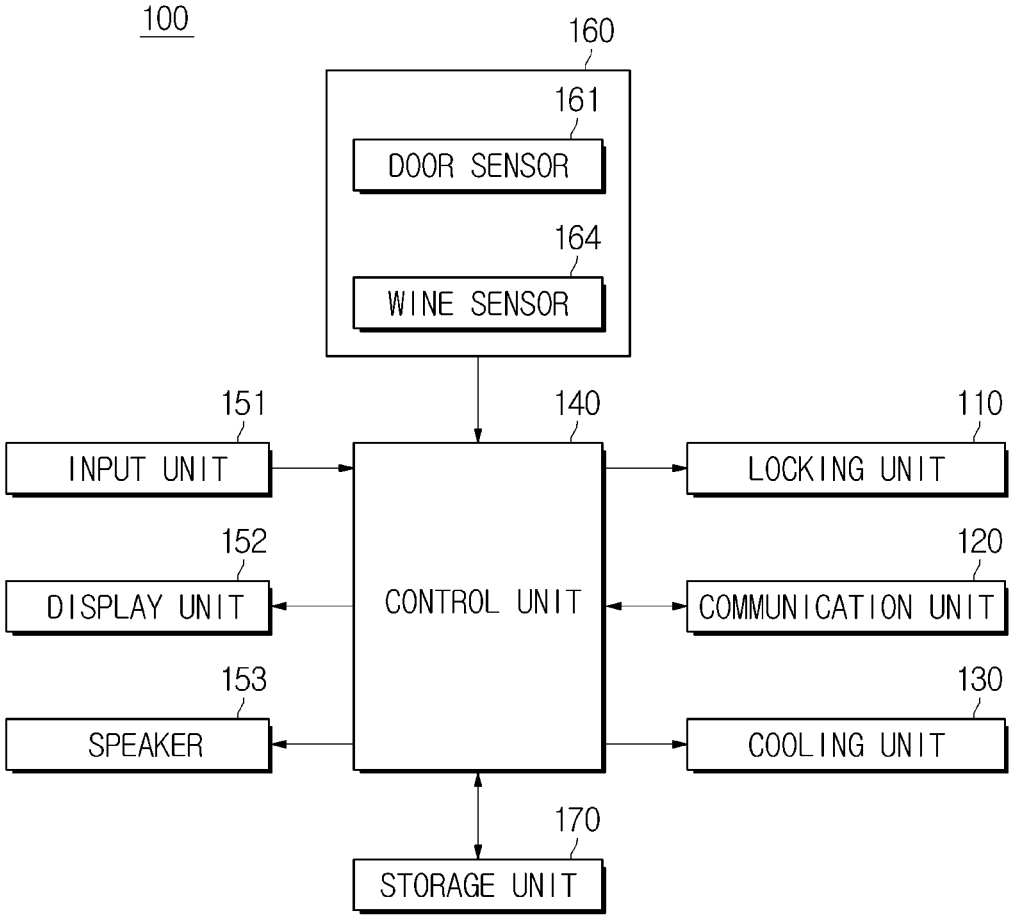
FIG. 20 is a control block diagram of the refrigerator which further includes a wine sensor.
Figure 21:
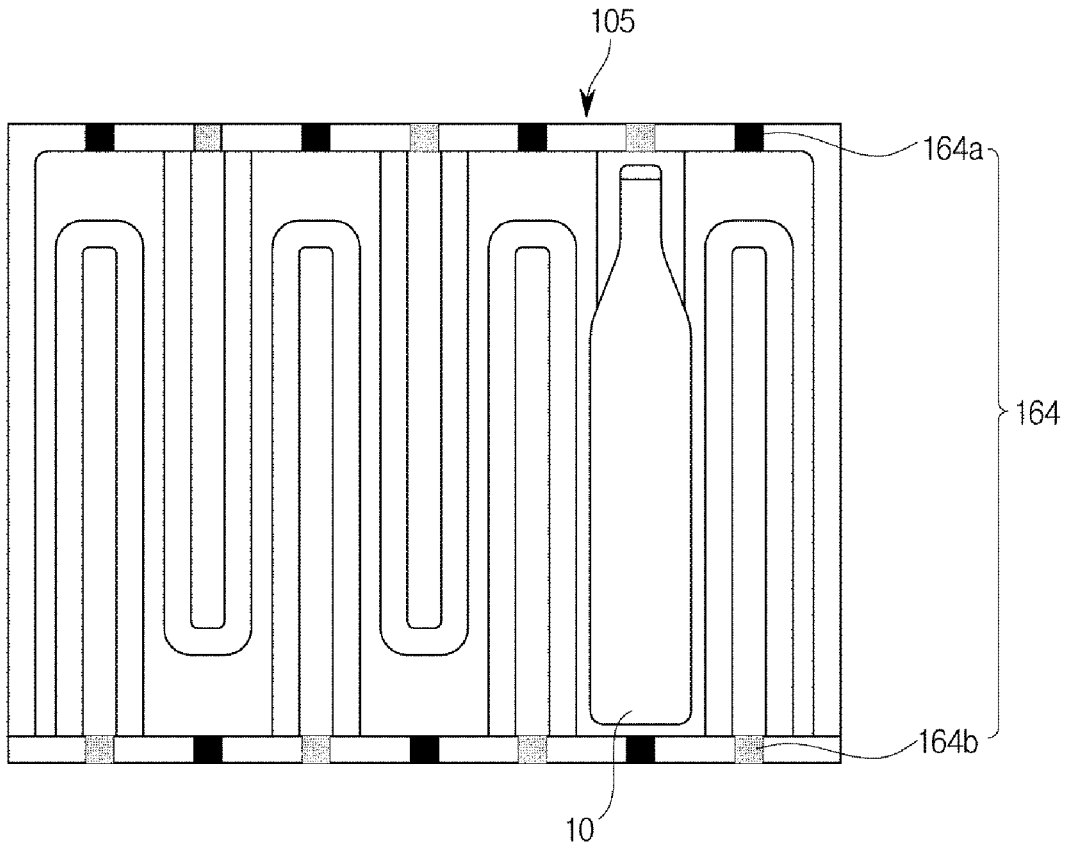
FIG. 21 is a view illustrating an example of the wine sensor.

FIG. 20 is a control block diagram of the refrigerator which further includes a wine sensor. FIG. 21 is a view illustrating an example of the wine sensor;

Referring to FIG. 20, the sensing unit 160 of the refrigerator 100 according to one embodiment of the present disclosure may further include a wine sensor 164 which senses the wine bottles 10 stored on the rack 105. Since an example in which the refrigerator 100 stores wine in the corresponding embodiment is described, the sensor is referred to as a wine sensor. Accordingly, the name of the sensor 164 may change according to the kind of food stored in the refrigerator 100.

The wine sensor 164 may be embodied as at least one of an IR sensor, an ultrasonic sensor, an optical sensor, a pressure sensor, a contact sensor, a proximity sensor, a weight sensor, and an image sensor. However, the sensors are merely examples applicable to the refrigerator 100 according to one embodiment of the present disclosure, and the type of the wine sensor 164 is not limited thereto.

As shown in FIG. 21, the wine sensor 164 may be installed on the rack 105. In the corresponding embodiment, the wine sensor 164 includes a transmission unit 164*a* which transmits IR rays and a reception unit 164*b* which receives IR rays.

As a detailed example, the transmission unit 164*a* and the reception unit 164*b* may be installed at positions corresponding to both ends of the wine bottle 10. When the wine bottle 10 is stored at an assigned position, the IR rays transmitted by the transmission unit 164*a* do not arrive at the reception unit 164*b* or partially arrive. Accordingly, it may be determined based on the strength of the IR rays received by the reception unit 164*b* whether the wine bottle 10 is stored at the assigned position. The wine sensor 164 may transmit signals which indicate existence/nonexistence of wine to the control unit 140, or the control unit 140 may determine the existence/nonexistence of wine based on an output value of the reception unit 164*b*.

Also, the wine sensor 164 may be installed at each of the positions capable of storing the wine bottles 10 to sense a position at which each of the wine bottles 10 is stored or whether the wine bottle 10 exists at each storage position. Hereinafter, a space which stores one wine bottle will be referred to as a cell.

Information on the positions of the wine bottles 10 may be provided to the user through the display unit 152 provided on the refrigerator 100 or the terminal 200. When the user cannot take appropriate measures against opening of the door 103 or the wine bottle 10 is stolen even though there was given a warning against the opening of the door 103, the control unit 140 may determine in which cell the stolen wine bottle was stored based on an output signal of the wine sensor 164.

The control unit 140 may provide information on the cell in which the stolen wine bottle is stored, information on theft time, etc. to the user through the display unit 152 or the terminal 200. Thereby, the user may be allowed to check which wine bottle is stolen.

Also, the wine sensor 164 may recognize information on the wine bottle 10. For example, when a wine bottle 10 with a tag including information on the wine is stored on the rack 105, the wine sensor 164 may recognize the information on the wine by reading the tag. The recognized information may be transmitted to the control unit 140.

The tag may be embodied in the forms of a one-dimensional bar code, a two-dimensional bar code (QR code), etc. or may be embodied as an RFID tag or an NFC tag. The tag may be attached to the bottom of the wine bottle 10.

Also, according to a type of a tag, a type of the wine sensor 164 may become different, or an additional tag reader may be further provided to the refrigerator 100, in addition to the wine sensor 164. For example, when the tag is embodied as an RFID tag, the refrigerator 100 may further include an RFID reader.

The information on the wine may include identification information given to the corresponding wine. For example, when the wine sensor 164 or the additional tag reader reads the tag and transmits identification information given to the corresponding wine to the control unit 140, the control unit 140 may bring information on wine corresponding to the identification information from the storage unit 170 or a wine database stored in an external server. For example, origin, variety, production year, grade, price, expiration date, food well-matched with the wine may be brought.

Otherwise, such information described above may be included in the tag.

The information on the wine may be provided to the user through the display unit 152 or the speaker 153 provided in the refrigerator 100 or may be provided to the user through the terminal 200.

When the information on the wine stored in the refrigerator 100 is provided to the user, the user may select, a necessary, one of the wine bottles 10 without opening the refrigerator 100. Also, when the position of the wine bottle 10 is provided to the user, time needed for taking out the necessary wine bottle 10 from the refrigerator 100 may be reduced.

Also, when a wine bottle 10 is stolen, the user may find out not only the position of the stolen wine bottle 10 but also may determine the kind.

Also, a taking-out history of the wine bottles 10 may be managed using an image captured by the image sensor 162 while the wine bottle 10 is being taken out. For this, the storage unit 170 may map and store the information on the wine bottle 10 taken out to the image captured when the corresponding wine bottle 10 is taken out or information on a person who takes out the corresponding wine.

The information on the person who takes out the wine bottle 10 may be obtained by the control unit 140 through recognizing the face included in the image taken or may be obtained using tag information read by the sensing unit 160 when an NFC tag, an RFID tag, etc. are used to take the wine bottle 10 out. Also, when a password or a security code is assigned to each of the persons authorized to open the door 103, that is, users allowed to open the door 103, the information on the person who takes out the wine bottle may be obtained based on the password or security code input to take out the wine bottle 10.

As described above, when the wine taking-out history is managed, not only the kind of the stolen wine bottle 10 but also preference for the wine may be recognized, a point in time of the wine consumption may be recognized, and the preference for the wine or the point in time of consumption thereof may be recognized and managed for each user.

Hereinafter, an example of a method of controlling a refrigerator according to one embodiment of the present disclosure will be described. The refrigerator 100 according to the embodiment described above may be used to perform the following method of controlling a refrigerator. Accordingly, the description related to the refrigerator 100 described above may be applied to the following method of controlling a refrigerator.

The method of controlling a refrigerator according to one embodiment of the present disclosure is assumed to be capable of locking the door 103 of the refrigerator by operating the terminal 200.

Figure 22:
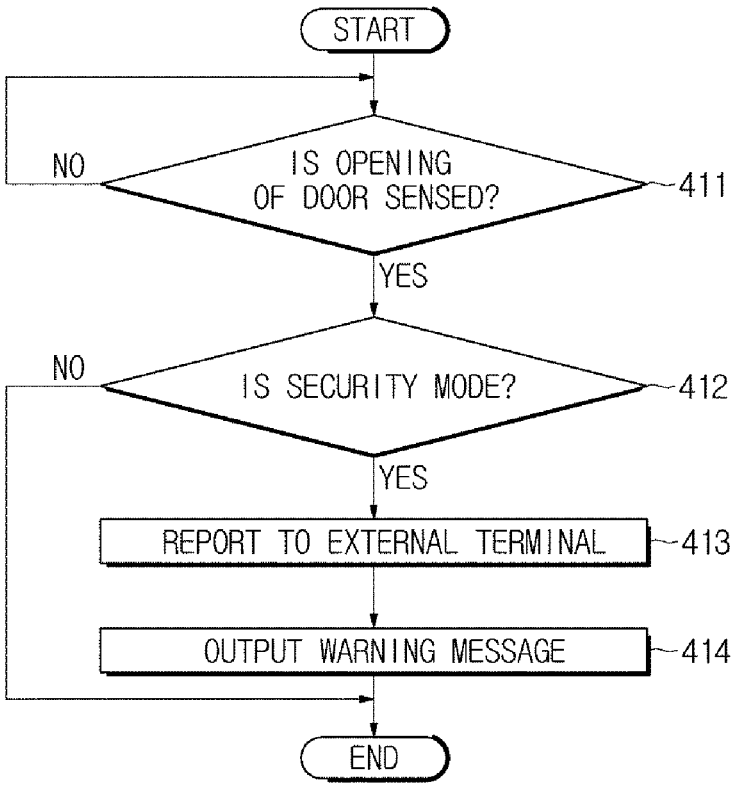
FIG. 22 is a flowchart illustrating an example of a method of controlling the refrigerator according to one embodiment of the present disclosure.

FIG. 22 is a flowchart illustrating an example of a method of controlling the refrigerator according to one embodiment of the present invention.

Referring to FIG. 22, when the door sensor 161 senses opening of the door 103 (YES in 411) and the refrigerator 100 is set in a security mode (YES in 412), the control unit 140 may transmit a door opening signal to the terminal 200 to report unauthorized opening of the door 103 (413).

Also, a warning message which reports the opening of the door 103 is unauthorized may be output through the display unit 152 or the speaker 153 (414). The output of the warning message may be automatically performed by the control unit 140 or may be performed when a control command for outputting a warning is received from the terminal 200.

Otherwise, the warning message may be not output or an ambient image of the refrigerator may be captured using the image sensor 162 after outputting the warning message. The output of the captured image may be automatically performed by the control unit 140 or may be performed when a control command for capturing an image is received from the terminal 200. The captured image may be transmitted to the terminal 200.

Otherwise, the warning message may be immediately output without transmitting the door opening signal to the terminal 200.

Also, it may be further included when a wine bottle is taken out to determine information on the wine bottle taken out based on output data of the wine sensor 164 and transmit, to the terminal 200, the information on the wine bottle taken out.

Also, the information on the wine bottle taken out may be mapped on information on a person who takes out the wine bottle and stored in the storage unit 170 to manage wine taking-out history.

Figure 23:
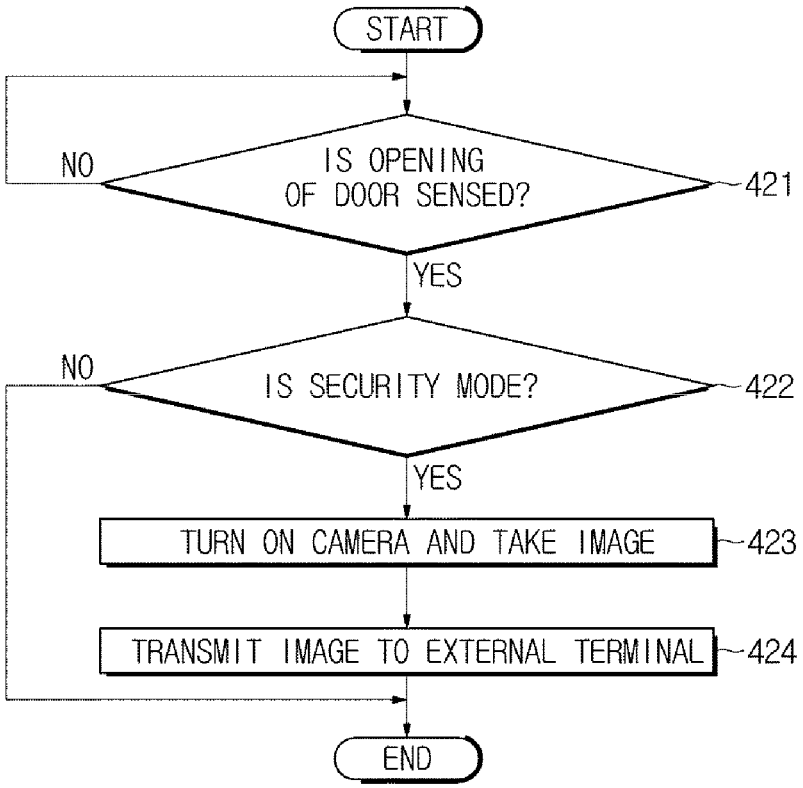
FIG. 23 is a flowchart illustrating another example of the method of controlling the refrigerator according to one embodiment of the present disclosure.

FIG. 23 is a flowchart illustrating another example of the method of controlling the refrigerator according to one embodiment of the present invention.

Referring to FIG. 23, when the door sensor 161 senses opening of the door 103 (YES in 421) and the refrigerator 100 is set in a security mode (YES in 422), the control unit 140 turns on a camera, that is, the image sensor 162, to take an ambient image of the refrigerator (423). The image sensor 162 may be installed toward a front of the refrigerator 100 and may take an image of the face of a person who opens the door 103.

The captured image is transmitted to the terminal 200 (424). The display unit 210 provided at the terminal 200 may display the transmitted image, and a user may check the transmitted image and take appropriate measures. For example, the terminal 200 may transmit a control command for outputting a warning to the refrigerator 100 and the refrigerator 100 may output a warning message, which reports that opening is unauthorized, through the display unit 152 or the speaker 153.

Figure 24:
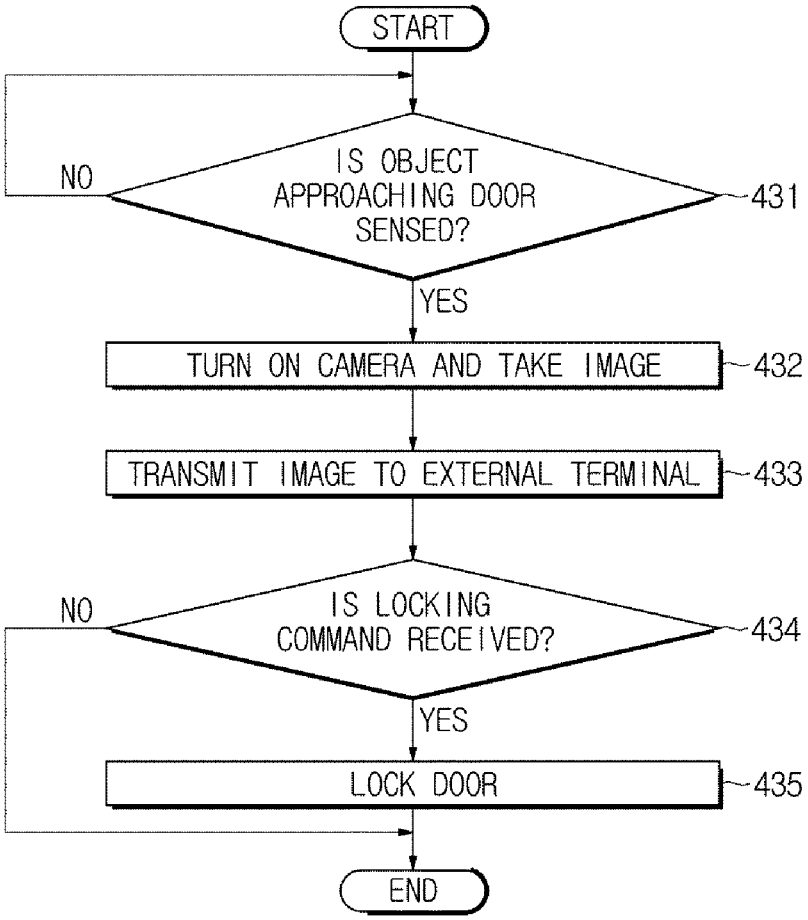
FIG. 24 is a flowchart illustrating still another example of the method of controlling the refrigerator according to one embodiment of the present disclosure.

FIG. 24 is a flowchart illustrating still another example of the method of controlling the refrigerator according to one embodiment of the present invention.

Referring to FIG. 24, when the proximity sensor 163 senses an object which approaches the door 103 within a preset distance (YES in 431), the control unit 140 may turn on the image sensor 162 to take an ambient image of the refrigerator 100 (432).

The captured image may be transmitted to the terminal 200 (433), and the user may check the image displayed on the display unit 210 of the terminal 200 and may input a control command for locking the door 103, that is, a locking command. The terminal 200 may transmit the locking command to the refrigerator 100.

When the locking command for the door 103 is received from the terminal 200 (YES in 434), the control unit 140 may control the locking unit to lock the door 103 (435).

Otherwise, to further tighten security, even when the locking command is not received from the terminal 200, the door 103 may be locked by controlling the locking unit 110.

Otherwise, before locking the door 103, a warning message, which reports the approach is unauthorized, may be output through the display unit 152 or the speaker 153.

As is apparent from the above description, security performance may be improved by performing a lock/unlock function remotely from far away.

Also, an approach of an unauthorized person, opening of a door, etc. are reported to a user far away to take appropriate measures or to determine a thief or stolen food.

Although a few embodiments of the present disclosure have been shown and described, it would be appreciated by those skilled in the art that changes may be made in these embodiments without departing from the principles and spirit of the present disclosure and such changes can not be separately understood from the present disclosure, the scope of which is defined in the claims and their equivalents.

Also, the terms used herein are to explain the embodiments and are not intended to limit and/or define the present disclosure. For example, singular expressions used herein, unless contextually otherwise defined, may include plural expressions.

Also, throughout the specification, the terms "comprise", "have", etc. are used herein to specify the presence of stated features, numbers, steps, operations, elements, components or combinations thereof but do not preclude the presence or addition of one or more other features, numbers, steps, operations, elements, components, or combinations thereof.

Also, the terms "unit", "device", "block", "member", "module", etc. used herein may mean a unit which performs or processes at least one function or operation. For example, they may mean software stored in a memory or hardware such as a field-programmable gate array (FPGA) and an application specific integrated circuit (ASIC). However, the terms "unit", "device", "block", "member", "module", etc. are not limited to the software or hardware and may be components stored in an accessible storage medium and executed by one or more processors.

What is claimed is:

1. A food storage apparatus comprising:

a body in which a storage space for storing food is formed;

a door installed on the body to be openable;

a locking unit which locks the door;

a communication unit which communicates with an external terminal to receive a locking command;

an image sensor installed to face toward front or side of the body to take an ambient image of the door;

a proximity sensor which senses an object which approaches the door; and a control unit which controls the locking unit to lock the door when the locking command is received from the terminal, wherein the control unit controls the image sensor to capture an image when the proximity sensor senses an object which approaches the door within a preset distance.

2. The food storage apparatus of claim 1, wherein the locking unit comprises:

a bracket installed at the door;

a shaft installed at the body to be connectable to or separable from the bracket; and a locking motor which provides power for connecting or separating the shaft to or from the bracket.

3. The food storage apparatus of claim 1, further comprising a door sensor which senses opening and closing of the door.

4. The food storage apparatus of claim 3, wherein the communication unit transmits a door opening signal to the terminal when the door sensor senses opening of the door.

5. The food storage apparatus of claim 3, wherein the control unit controls the image sensor to take an image when the door sensor senses opening of the door.

6. The food storage apparatus of claim 1, wherein the communication unit transmits the image captured by the image sensor to the terminal.

7. The food storage apparatus of claim 3, further comprising:

at least one of a display unit and a speaker, wherein when the opening of the door is sensed, the control unit controls at least one of the at least one of a display unit and a speaker to output a warning which reports that the opening is unauthorized.

8. A food storage apparatus comprising:

a body in which a storage space for storing food is formed;

a door installed on the body to be openable;

a locking unit which locks the door;

a communication unit which communicates with an external terminal to receive a locking command;

a proximity sensor which senses an object which approaches the door; and a control unit which controls the locking unit to lock the door when the locking command is received from the terminal, wherein the communication unit transmits an object approach signal to the terminal when the proximity sensor senses an object which approaches the door within a preset distance.

9. A food storage apparatus comprising:

a body in which a storage space for storing food is formed;

a door installed on the body to be openable;

a locking unit which locks the door;

a communication unit which communicates with an external terminal to receive a locking command;

a proximity sensor which senses an object which approaches the door; and a control unit which controls the locking unit to lock the door when the locking command is received from the terminal, wherein the control unit controls the locking unit to lock the door when the proximity sensor senses an object which approaches the door within a preset distance.

10. A food storage apparatus comprising:

a body in which a storage space for storing food is formed;

a door installed on the body to be openable;

a locking unit which locks the door;

a communication unit which communicates with an external terminal to receive a locking command;

a proximity sensor which senses an object which approaches the door;

a control unit which controls the locking unit to lock the door when the locking command is received from the terminal; and at least one of a display unit and a speaker, wherein when the proximity sensor senses an object which approaches the door within a preset distance, the control unit controls at least one of the at least one of a display unit and a speaker to output a warning which reports that the approach is unauthorized.

11. The food storage apparatus of claim 1, further comprising:

a rack formed in the body to store food; and a food sensor installed on the rack to sense whether the food is stored.

12. The food storage apparatus of claim 11, wherein the control unit determines information on food taken out based on output data of the food sensor, and wherein the communication unit transmits, to the terminal, the information on the food taken out.

* * * * *